United States Patent [19]

Hooker

[11] 4,359,842

[45] Nov. 23, 1982

[54] TRAPEZOIDAL STRUCTURES

[76] Inventor: Rea F. Hooker, 170 W. 74th St., New York, N.Y. 10023

[21] Appl. No.: 55,904

[22] Filed: Jul. 9, 1979

Related U.S. Application Data

[63] Continuation-in-part of Ser. No. 868,329, Jan. 10, 1978, abandoned.

[51] Int. Cl.[3] ..... E04B 1/32; A63H 33/16

[52] U.S. Cl. ..... 52/18; 52/71; 52/82; 52/86; 52/DIG. 10; 46/1 L

[58] Field of Search ..... 46/1 L; 52/18, 70, 73, 52/86, 71, 82, DIG. 10

[56] References Cited

U.S. PATENT DOCUMENTS

| | | | |
|---|---|---|---|
| 2,164,966 | 7/1939 | Tutein | 46/1 L X |
| 3,016,115 | 1/1962 | Harrison et al. | 52/18 |
| 3,302,321 | 2/1967 | Walker | 46/1 L |
| 3,346,998 | 10/1967 | Nelson | 46/21 X |
| 3,407,546 | 10/1968 | Yates et al. | 52/18 |
| 3,848,356 | 11/1974 | Wylie | 46/1 L |
| 3,854,266 | 12/1974 | Salas | 52/18 X |
| 3,894,352 | 7/1975 | Hooker | 46/1 L |
| 4,074,477 | 2/1978 | Runyon | 52/86 |
| 4,142,321 | 3/1979 | Coppa | 46/1 L |

FOREIGN PATENT DOCUMENTS

| | | | |
|---|---|---|---|
| 653204 | 11/1962 | Canada | 52/86 |
| 1016266 | 1/1966 | United Kingdom | 56/86 |

*Primary Examiner*—F. Barry Shay

*Attorney, Agent, or Firm*—Abner Sheffer

[57] ABSTRACT

Architectural structures made up of a set of trapezoids arranged in pleated relationship, interfitted with another interfitting, transverse set of polygons also arranged in pleated relationship.

10 Claims, 130 Drawing Figures

TRAPEZOIDAL STRUCTURES

This application is a continuation-in-part of Ser. No. 868,329 filed Jan. 10, 1978, now abandoned.

Reference is made herein to my U.S. Pat. No. 4,001,964, Jan. 11, 1977, which describes trapezoidal structures. Architectural structures composed of triangles are shown in U.S. Pat. No. 3,346,998 and Canadian patent No. 653,204. Other structures of triangular elements are shown in U.S. Pat. Nos. 2,164,966; 3,302,321 and 3,894,352.

This invention provides light weight architectural structures, suitable for shelters for people or storage which can be erected easily and quickly from identical repeating elements, or units, and which have high strengths in relationship to their weights. The same elements and combinations may be employed for making several different types of shelters; for instance, these may be radial, arcuate or linear, as illustrated herein. The elements may be hinged together (or a large sheet may be folded to form the elements) at one site and put into a collapsed form for easy shipment to the desired location where the collapsed structure may be expanded to form the shelter.

While, as mentioned above, models of the structure may be made from relatively small cardboard blanks, the architectural structure will of course be of a size (e.g. having a height of 6 feet or more) such that persons can be housed therein.

Suitable materials of construction include such materials as sheets or panels of metal or plastic or metal-glass-or graphite fiber-reinforced plastic. These may be hinged together at their edges, as by applying tape (with suitable adhesive at the edges) or by forming a hinge in situ (e.g. by applying a material that sets to a flexible plastic, such as an elastomeric silicone, along the mating edges) or by providing mating hinge elements along the edges and inserting hinge pins to secure the edges together. A skeletal construction may be employed, in which there are rods defining the edges of the polygonal elements and these rods are joined together at common vertices of those elements by couplers each which may have a plurality of sockets for receiving the rods; the sockets of each coupler may be movable relative to one another for convenience in erecting the structure. The skeletal structure may be covered with any suitable material which may be of very light weight, e.g. canvas, plastic film or sheet, thin metal sheeting, etc., appropriate to the environment in which the shelter is to be employed.

The various configurations may be put to different uses. For instance, the arcuate configurations discussed below may be used as portable stages for theatrical performances, the radial structures may be used as on-site shelters in harsh or unstable environments, e.g. in swampy areas, areas of high snowfall, deserts, or even outer space. The canopy or base portions, or both, of the structures may be enclosed, as by a ceiling or floor and the structure may be made water tight as by application of suitable sealing means or sealing compositions to the edges, while a suitable access hatch may be provided in floor or ceiling. Many of the illustrated structures are open on one side (e.g. the radial structures may have a free middle zone); this may of course be enclosed.

One may employ materials and methods of construction like those described (for triangular structures) in U.S. Pat. No. 3,346,998 and Canadian No. 653,204.

The invention is illustrated in the accompanying drawings in which

Figure 1:
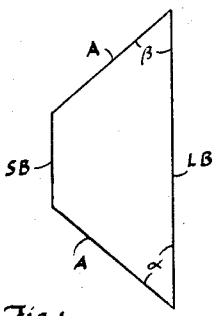
FIG. 1 is a diagram of a trapezoid, illustrating the nomenclature used.

The structures of this invention are built up from trapezoidal forms. In describing the trapezoids the nomenclature shown in FIG. 1 will be used herein. That is, the trapezoids have a long base LB, a parallel short base SB and two angled sides, hereinafter called the "A-sides". The "altitude" is, of course, the distance between the long base and the short base.

Figure 2:
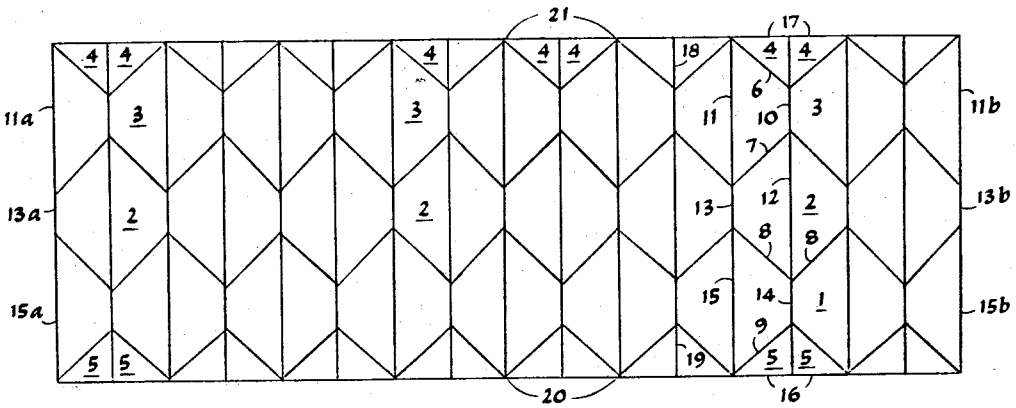
FIG. 2 is a "blank" make up of a series of trapezoids.
Figure 3:
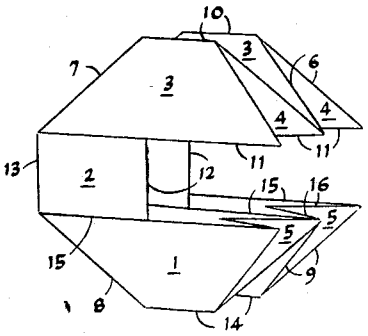
FIG. 3 shows a portion of that blank after "folding"

In many of the structures shown herein one basic subcombination uses at least two sets of trapezoids, having common A-sides. Thus in FIG. 2 the trapezoids 2 and 3 have a common A-side 7. Here the trapezoids 2 (arranged in the arc of a circle) may act as substantially vertical supports for the trapezoids 3 (which extend outward substantially radially of that arc), which may form a canopy as illustrated in FIG. 3 with their other A-sides 6 (hereafter termed their "end A-sides") at the outer surface of the canopy. The spaces between those and A-sides 6 may be free, or filled in; e.g. (as illustrated in FIGS. 2,3,5,6, and 7) they may be filled in with pairs of triangles 4.

For convenience in visualization the drawings of this application will be described in terms of structures that can be produced from small cardboard blanks folded along predetermined score lines. It will be understood, however, as discussed below, that those structures may be made of precut individual panels, or groups or hinged panels, which may be later assembled and joined together (e.g. at the construction site), with or without forming intermediate sub-assemblies. The "blanks" illustrated in the drawings thus are "maps" of flat projections of whole structures and illustrate the relationships of the individual panels; the lines on the blanks are, as previously indicated, score lines for folding such blanks. The direction of each fold will be readily understood from the views of the folded and/or unfolded structures.

The structures of FIGS, 5, 6, and 7 are composed of three sets of identical trapezoidal elements 1,2,3 and two sets of identical triangular elements 4,5 connected together at their abutting sides. The corresponding "blank" is shown in FIG. 2; its lines (score lines) correspond to the lines along which the elements are connected. To construct the structure of FIG. 5 from this blank, the latter is folded along the score lines. The center set of trapezoids 2 may be held vertical while the upper set of trapezoids 3 is folded down and the lower set of trapezoids 1 is folded up, so as to attain the configuration illustrated (in part) in FIG. 3; that configuration may be flattened or collapsed to the configuration shown in FIG. 4 for storage or shipment. Then the opposite sides of the folded structure are brought together and joined (in effect joining the opposite ends 11*a*, 13*a*, 15*a*, 11*b*, 13*b*, 15*b* of the blank of FIG. 2 to make a new fold line) to produce the structure shown in FIG. 5; from a $21\times7\frac{3}{4}$ inch flat blank or rectangular blank (FIG. 2) of cardboard there is formed a structure (of FIG. 5; about 7 inches in diameter, about $3\frac{1}{4}$ inches high, with an open section, indicated by $h_F$ on FIG. 5, occupying about $\frac{1}{3}$ of the total height.

Figure 5:
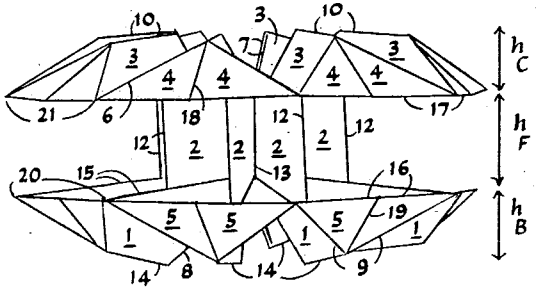
FIG. 5 shows a radial structure made from that blank.
Figure 6:
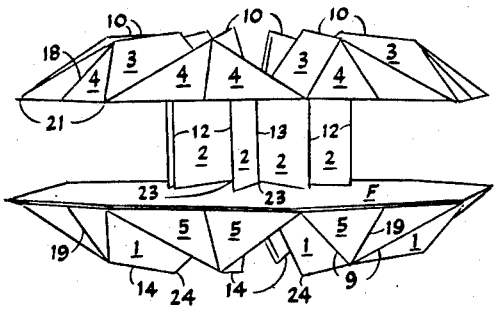
FIGS. 6 and 7 are views of a structure like that of FIG. 5 and showing an added floor.
Figure 7:
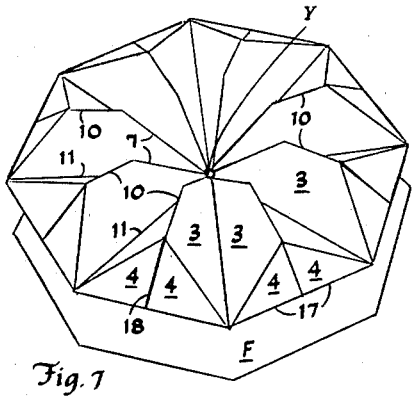

In FIG. 5 it will be seen that the connected long edges 15 of the lower trapezoidal elements 1 are all substantially on the same level. A flat horizontal floor (F in FIGS. 6 and 7) can be laid onto those edges to cover the entire lower portion, including the triangular areas 23 available beween the connected vertical trapezoid elements 2. Similarly a flat horizontal ceiling can, if desired, be placed on the corresponding long edges 11 of the upper trapezoidal elements 3. It will be seen that placement of the floor creates a set of bottom compartments below the floor, while placement of the ceiling creates a similar set of upper compartments. There is a small hollow central passage Y in the central vertical core where the short edges 13 of the central trapezoids 2 come together. For use as a floating structure the bottom compartments may be sealed against entry of water, while the central passage Y may receive anchoring means (e.g. an anchoring cable connected to an anchor, and having a stop at its upper end, may pass through that passage).

When the blank shown in FIG. 2 (having 16 trapezoids, i.e. 8 pairs, in each set) is formed into the circular structure of FIG. 5 the circumferences of the structure are taut; that is, each pair of mirror-image triangles 4,4 (and 5,5) is substantially in a single plane the points 21, 20 thus cannot be moved further apart. This locks the structure, making its "rotation" (as described in my U.S. Pat. Nos. 3,894,352 and 4,001,964) practically impossible. If FIG. 2 is modified to increase the number of trapezoids in each set (e.g. to 9 pairs) the circumference of the resulting circular structure is no longer taut and the structure is not as stable unless some restraining means is added; such restraining means may be, for instance, a floor or ceiling (as previously described) or other means such as devices (e.g. pins or cables) for locking the short edges 13 together. With an increase in the number of trapezoids per set, the diameter of the central core may be increased and (in the middle set of trapezoids) adjacent trapezoids having common short bases may not be back-to-back but at an angle to each other. This may give a central core of still greater resistance to collapse under vertical loads.

In the structures shown in FIGS. 2,5,6 and 7 the free height ($h_F$ FIG. 5) between the canopy portion and the base portion is about one third the total height, and the heights ($h_B$ and $h_C$) of base portion and canopy portion, respectively, are also about one third the total height. The horizontal projections of the canopy and the base portions are substantially congruent. As can be seen from FIG. 3 the heights of the base portion and canopy portion will be determined by the altitudes of trapezoids 1 and 3, respectively, (the altitudes of all the trapezoids in this structure are identical) and the free height $h_F$ will be determined by the length of the short base 13 of the upstanding middle trapezoid.

Figure 8:
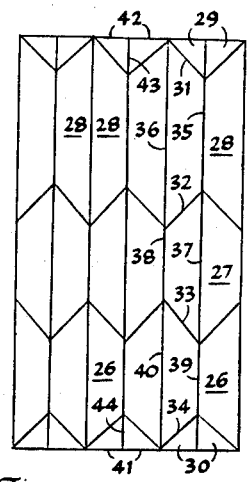
FIG. 8 shows part of another blank.
Figure 9:
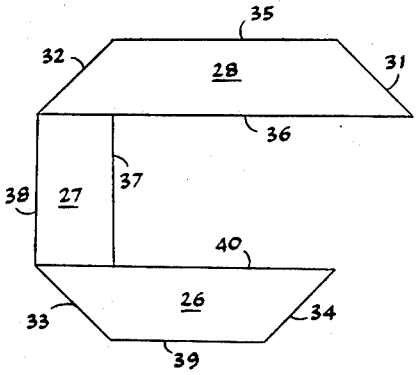
FIG. 9 shows how it is folded and FIGS. 10–11 are views of a radial structure made therefrom.
Figure 10:
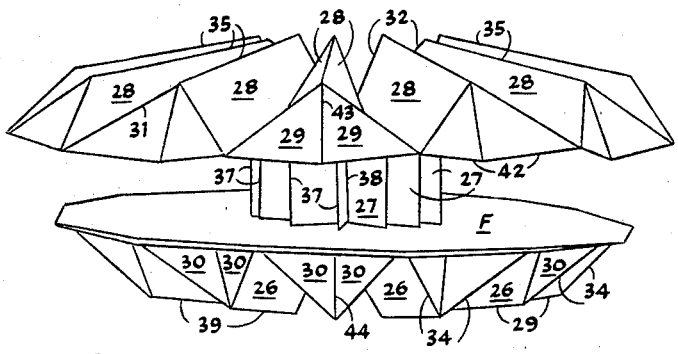
Figure 11:
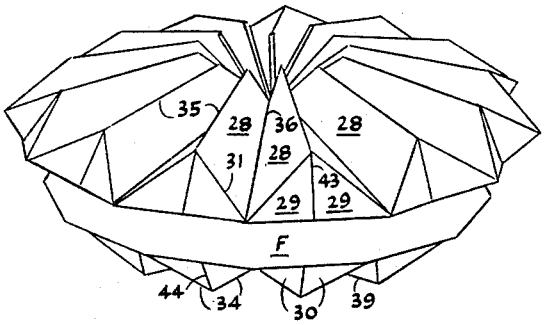

A structure having an overhanging canopy (extending outwardly of the base portion), such as illustrated in FIGS. 10 and 11 can be formed by lengthening the upper set of trapezoids 28) as compared to the middle and lower sets 27 and 26; this is also shown on the corresponding blank (FIG. 8 and folded collapsed structure (FIG. 9). The particular blank which is shown (partly) in FIG. 8 differs from that of FIG. 2 in several other respects. Thus, while all the angles between the bases of the trapezoids and their A-sides are the same (45° in each case) the altitudes of the trapezoids are less in FIG. 8 and the number of sets of trapezoids is greater (e.g. 13 pairs, as shown in FIG. 11, rather than 8). It will be appreciated that, all other things being equal, one needs more sets in order to obtain a canopy of greater circumference. If desired the dimensions and number of sets may be such that the circumference of the canopy is taut (while the smaller circumference of the base portion is not); this provides a stability at the top against change in configuration, as mentioned above, but stability can also be attained by the use of a floor (as shown at F in FIGS. 10 and 11) or by other securing means as previously described. It will be noted that the canopy in FIGS. 10 and 11 slopes downward from the center.

It will be understood from the drawings that the upper ridges 35 of the canopy are the shorter bases of the upper trapezoids; the bases of the valleys of the canopy are the longer bases 36 of those upper trapezoids; the upstanding central core supporting the canopy is formed of the middle trapezoids 27 whose long bases 37 form the outwardly projecting edges of the core and whose short bases 38 form the inwardly projecting edges at the center of that core; the structure rests on the short bases 39 (or portions or points thereof) of lower trapezoids 26 and the floor rests on the ridges formed by their long bases 40.

In the blanks shown in FIGS. 2 and 8 each of the trapezoids is symmetrical. FIGS. 12, 13, 14 and 15 show blanks and structures which are like those of FIGS. 8,9, 10 and 11 except that the trapezoids 45 of the top set are not only more elongated but also asymmetrical (angle $\alpha$ being still 45° but Angle $\beta$ being about 25°), and there are 16 pairs of trapezoids in each set. The canopy portion here has a still greater projected area (and circumference) and its overhang, past the projected outer limits of the base portion, is greater than in the structures of FIGS. 10 and 11.

It will be understood from the drawings that the upper ridges 48 of the canopy are the short bases of the upper trapezoids; the bases of the valleys of the canopy are the long bases 47 of those upper trapezoids; the upstanding central core supporting the canopy is formed of the middle trapezoids 27 whose long bases 37 form the outwardly projecting edges of the core and whose short bases 38 form the inwardly projecting edges at the center of that core; the structure rests on the short bases 39 (or portions or points thereof) of lower trapezoids 26 and the floor rests on the ridges formed by their long bases 40.

In the structure shown in FIGS. 16,17,18 and 19, all three sets of trapezoids 56, 57, 58 are asymmetrical, though congruent. The final structure has a central core (formed of the middle trapezoids 57) which flares outward upwardly; that is, in that structure the lower ends 53 (FIG. 17) of the short bases 64 of these middle trapezoids are close together or in contact while the upper ends 54 of those same short bases are spaced apart (uniformly). The long bases 63 of the core-forming middle trapezoids are similarly at angle to the vertical, and the canopy (formed by the upper trapezoids 58 whose short bases 66 form the upper ridges and whose long bases 65 form the bottoms of the valleys of the canopy) overhangs the base portion (formed by lower trapezoids 56 on whose short bases 62 the whole structure is supported and whose long bases 61 form floor-supporting ridges). Triangles 60 are so shaped, in this case, that their outer edges 74 take a position on substantially the same level as the ridges formed by long bases 61.

Figure 20:
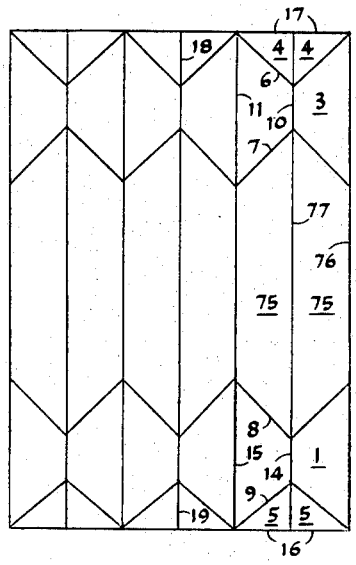
FIG. 20 shows part of a blank which provides a relatively greater free height and FIG. 21 shows a radial structure made therefrom.
Figure 21:
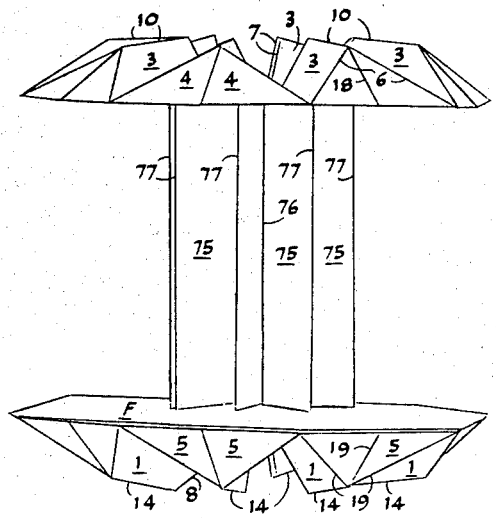

FIGS. 20 and 21 show structures like those of FIGS. 2,3,5,6 and 7 except that the free height $h_F$ between the canopy and the base portion is greatly increased by making the trapezoids 75 of the middle set much longer while all other relationships are unchanged. In these Figures the long bases 77 and short bases 76 of the middle, core-forming, trapezoids are substantially vertical as in FIGS. 5,6,7.

Figure 22:
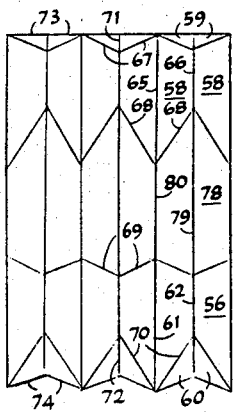
FIG. 22 shows part of a blank which provides an outwardly flaring core and FIG. 23 shows a radial structure made therefrom.
Figure 23:
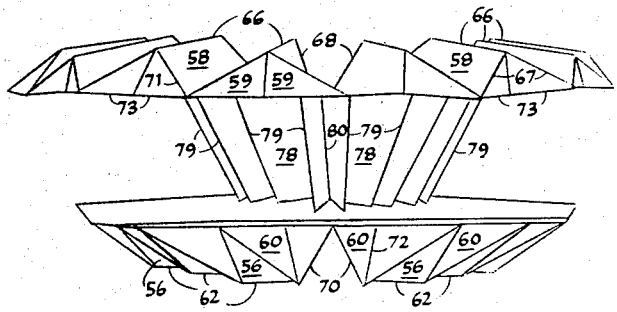

An increased height between canopy and base portion may also be obtained in the structures having outwardly flaring cores (shown, e.g., in FIG. 18) by lengthening the middle trapezoids. This is illustrated in FIGS. 22 and 23 in which the asymmetrical trapezoids 58, 56 of the upper and lower sets, respectively, are of identical shape, while the trapezoids 78 of the middle, core-forming, sets are uniformly longer. Thus the (long bases 79 of the middle trapezoids 78 are longer than the corresponding (long) bases 61 65 of the upper and lower trapezoids; and the (short) bases 80 of the middle trapezoids are longer than the corresponding (short) bases 66,62. (Here again the outer edges of 74 of the edge triangles are at angle to each other, for reasons described in connection with FIG. 16 above). It will be noted that in this case, unlike that of FIGS. 20 and 21, the increase in the length of the middle trapezoids results in an increase in the circumference of the canopy portion (and in its overhang with respect to the base portion) and thus may require an increase in the number of pairs of trapezoids as compared to those in FIGS. 16,17,18 and 19.

Figure 24:
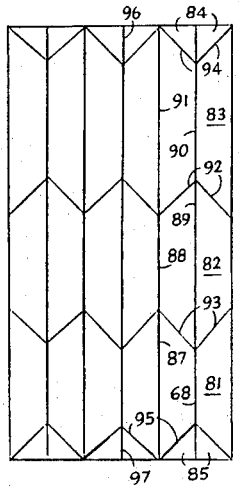
FIG. 24 shows part of still another blank.

FIG. 24 shows a blank like that of FIG. 2 except that the lengths of the upper, middle and lower trapezoids are unequal (in FIG. 24, upper trapezoids 83 are longer than middle trapezoids 82 which in turn are longer than lower trapezoids 81). It will be understood that this blank will form a structure with an overhanging canopy structure. While that structure may be radially symmetrical about a central core (as in the structures of FIGS. 10,11,14,15, 18,19,21 and 23), it may also (like those) take other forms, as will be discussed below.

Figure 25:
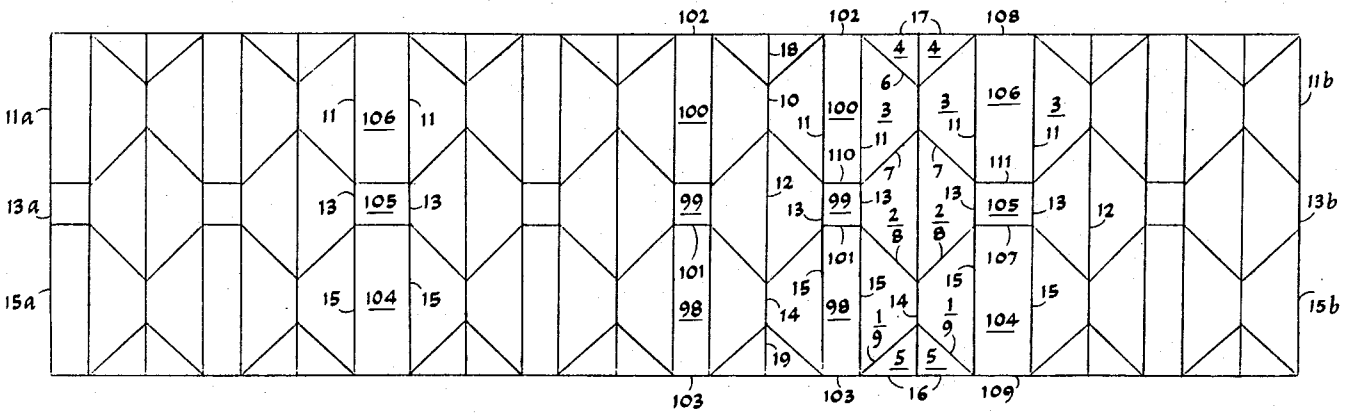
FIG. 25 shows a blank also containing rectangular elements and FIGS. 26–28 show a radial structure made therefrom.
Figure 26:
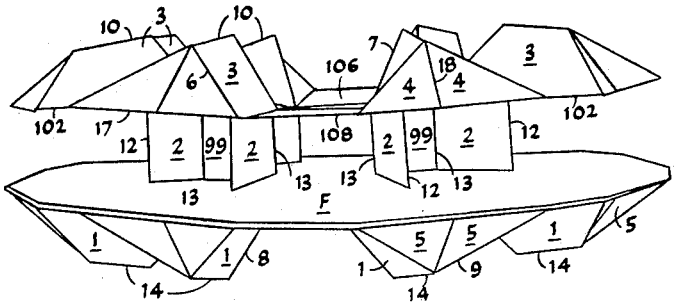
Figure 27:
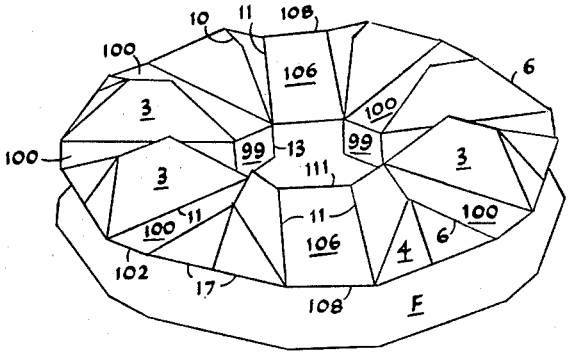
Figure 28:
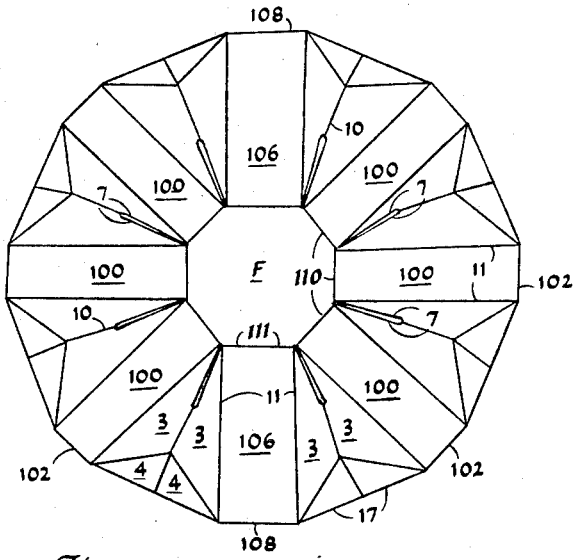

The trapezoidal elements may be combined with other elements, e.g. of rectangular configuration. Thus, in the blank shown in FIG. 25 there are the same pairs of upper trapezoids 3, middle trapezoids 2 and lower trapezoids 1, as in FIG. 2. But there are also rows of rectangles (such as 100,99,98 and 106,105,104) between adjacent rows of such pairs of trapezoids. The structure shown in FIGS. 26,27 and 28 is formed like that of FIGS. 5–7, by folding the blank along the illustrated score lines, unfolding it and securing its ends 11*a*, 13*a*, 15*a*, 11*b*, 13*b*, 15*b* together. It will be seen that the use of the trapezoid-separating rectangles makes for a central core area of larger diameter (as compared to FIGS. 5–7). In the illustrated embodiment, both the rectangles 105 are cut out (i.e. 105 represents an empty space); this provides two areas of access to the central core area. The presence of the rectangles 99 creates interior compartments, or bays, as can be seen in FIG. 26. In the illustrated embodiment there are (a) eight pairs of sets of trapezoids forming 8 spaced canopy peaks, 6 bays and 8 spaced lower support structures; and (b) 8 files of rectangles including (b.1) 6 files of narrower rectangles (100,99,98) forming 6 radially extending horizontal canopy portions (between the peaks), 6 inner walls of the bays and 6 radially extending horizontal base portions which may be just below the floor F or may form part of the floor, and (b.2) two files of wider rectangles (106,105,104) forming two aligned diametrically extending horizontal canopy portions, two open areas between bays and two aligned diametrically extending horizontal base portions which may be just below the floor F or may form part of the floor.

Figure 29:
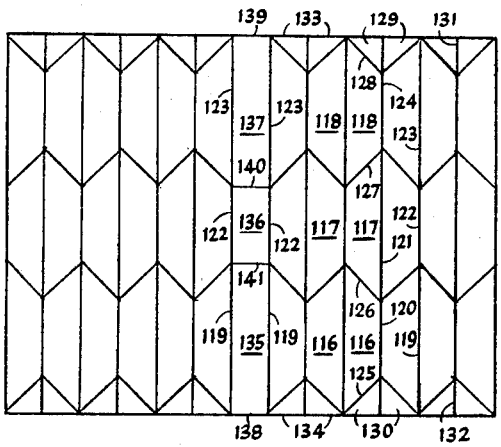
FIG. 29 shows part of another blank having rectangular elements and FIGS. 30–33 show a radial structure made therefrom.
Figure 30:
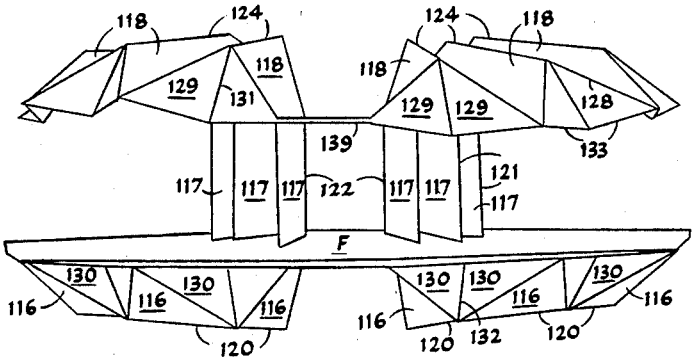
Figure 31:
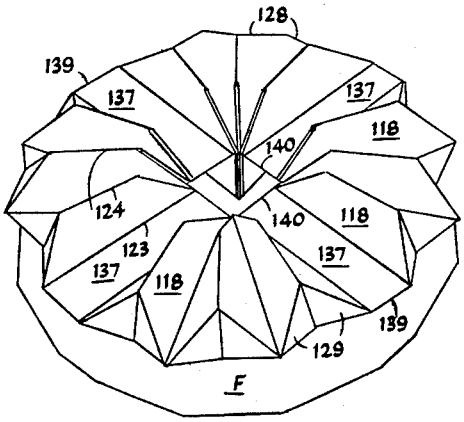
Figure 32:
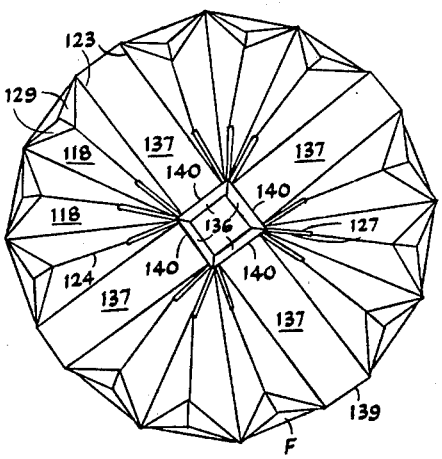

FIGS. 29, 30 and 31 illustrate a structure in which there is one file of trapezoid-separating rectangles for three files of pairs of trapezoids. The trapezoids used in this particular embodiment have a smaller altitude (in relation to their other dimensions) than those of FIG. 25. In the illustrated embodiment there are a total of b 24 files of trapezoids 118,117,116 (12 pairs, arranged in groups of three identical pairs) and 4 identical files of rectangles 137,136,135. When the rectangles 136 are actual elements, the central core of the structure is a closed rectangular tube formed by the four vertically arranged rectangles 136 (see FIG. 32) each of whose vertical sides is secured to four joined short bases of trapezoids 117. One, two, three or all four of the rectangles 136 may be cut out giving a corresponding number of access openings to the central core. The configuration of the structure may be secured in any suitable manner, as previously discussed, as by the use of a floor F (illustrated) and/or ceiling.

Figure 33:
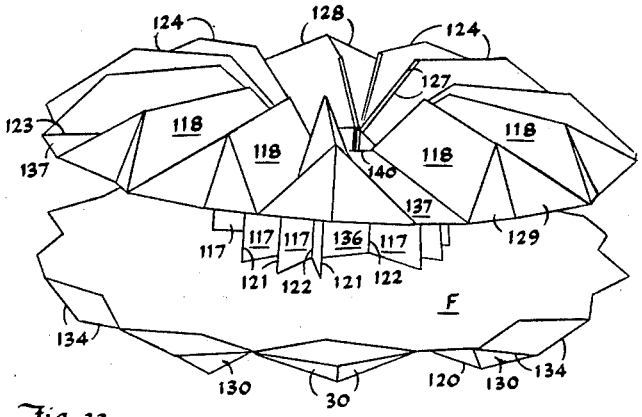

Incidentally, in FIG. 33 the lines joining the triangles 130 of each triangle pair in the base portion are folded outward revealing the interiors of the hollow compartments below the floor.

Figure 34:
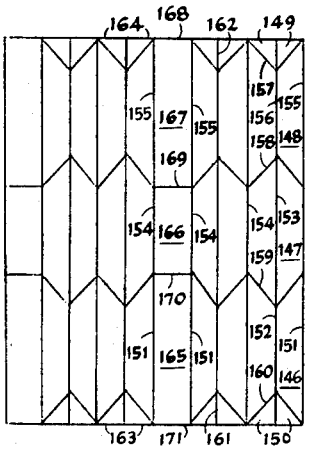
FIG. 34 shows part of still another blank having rectangular elements and FIGS. 35 and 36 show a radial structure made therefrom.
Figure 35:
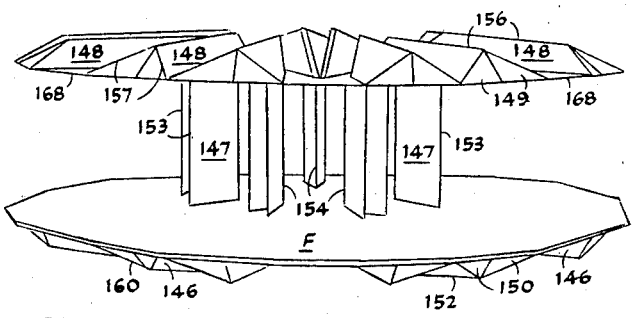
Figure 36:
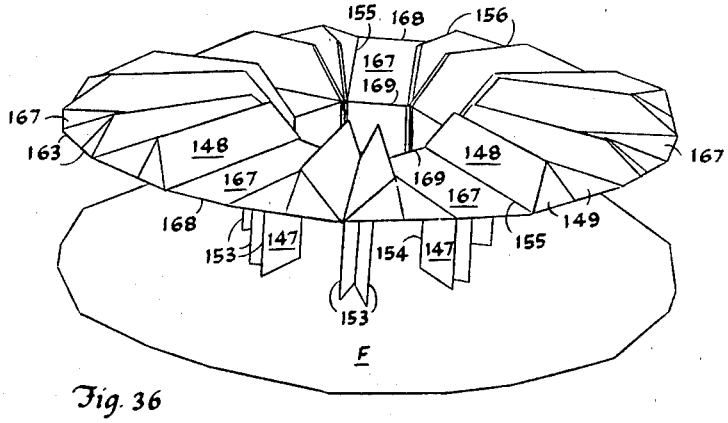

FIGS. 34,35 and 36 illustrate a structure in which there is one row of trapezoid-separating rectangles for two files of pairs of trapezoids. The trapezoids used in this particular embodiment have a still smaller altitude (in relation to their other dimensions) than those of FIG. 29. In the illustrated embodiment there are a total of 28 per files of trapezoids 148,147,146 (14 pairs, arranged in groups of two identical pairs) and 7 identical files of rectangles 167,166,165, all the rectangles 166 being cut out. The configuration of the structure may be stably secured in any suitable manner, as previously discussed, as by the use of a floor F (illustrated) and/or ceiling.

Figure 37:
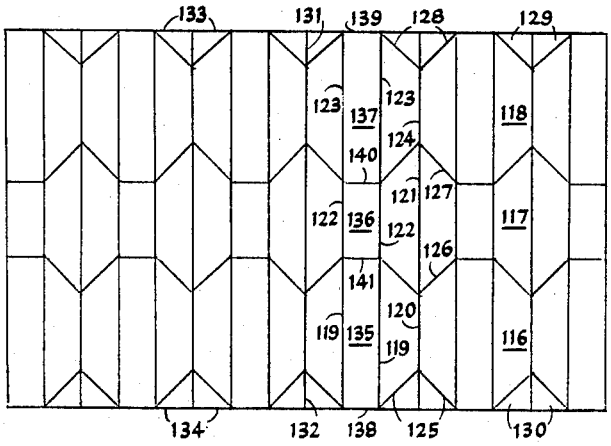
FIG. 37 shows part of another version of a blank having rectangular elements and FIGS. 38 and 39 show a radial structure made therefrom.
Figure 38:
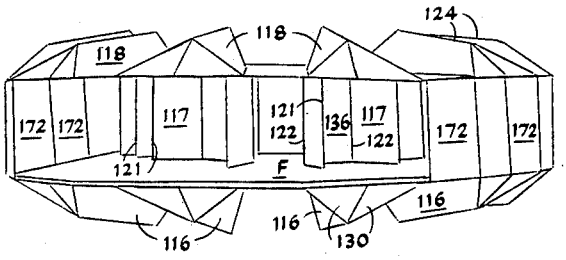
Figure 39:
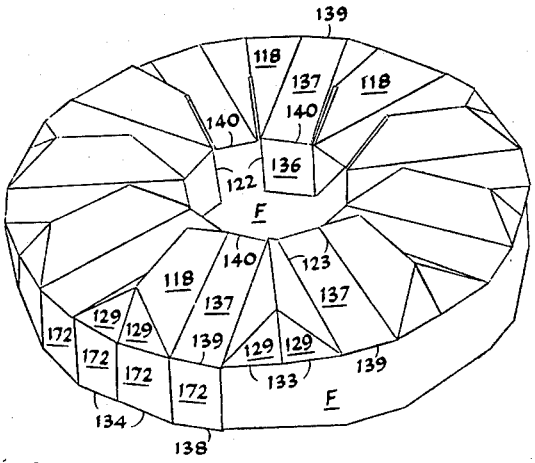

The structures shown in FIGS. 37,38 and 39 are like those of FIGS. 29,30–33 except that identical files of rectangular separations are positioned between files of single pairs of identical trapezoids. In the illustrated embodiment there are a total of 20 files of trapezoids 118,117,116 (10 pairs forming ten radially extending canopy peaks and a corresponding ten support structures and ten inwardly extending bay walls, for five bays) and 10 identical files of rectangles 137,136,135, five of the middle rectangles 136 are cut out so that there are five accesses to the central areas, while the other five rectangles 136 form the inner walls of the five bays. Also outer wall elements (which may be rectangles 172) may be applied to any portions, or all, of the perimeter of the free space between the canopy and the base portion of the structure; this, of course, may also be done with any of the other structures (such as those previously described).

Figure 40:
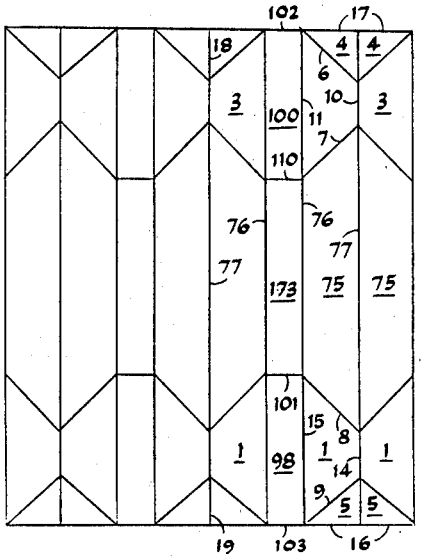
FIG. 40 shows part of another form of blank having rectangular elements.

In FIGS. 40 the middle trapezoids 75 are longer than the upper and lower trapezoids as in FIG. 20 with arrangement of rectangles and trapezoids like that of FIG. 37 except that the middle trapezoids 75 (and middle rectangles 173) are much longer than the upper and lower trapezoids 3 and 1 and upper and lower rectangles 100 and 98. This gives structures whose free height is proportionately increased (or whose canopy and base diameters are decreased).

Figure 41:
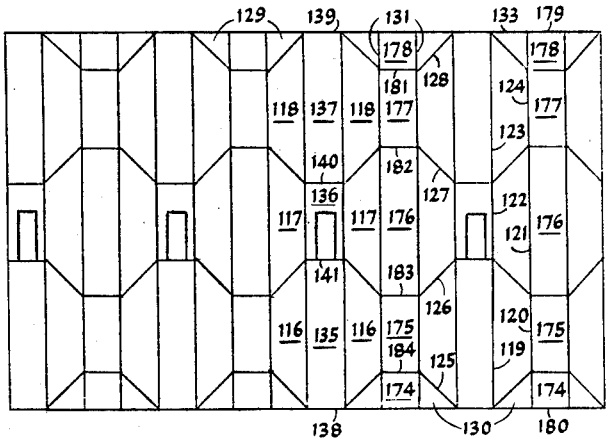
FIG. 41 shows part of a blank having rectangular elements and cut-out portions and FIGS. 42 and 43 show a radial structure made therefrom.
Figure 42:
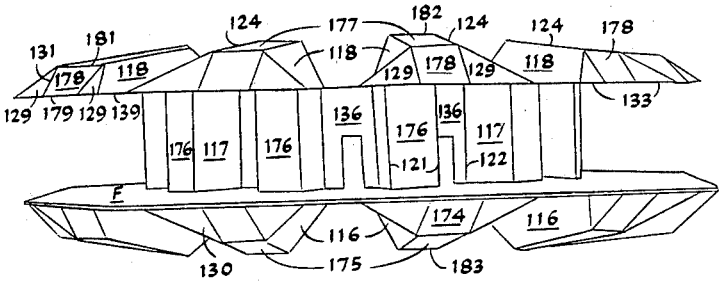
Figure 43:
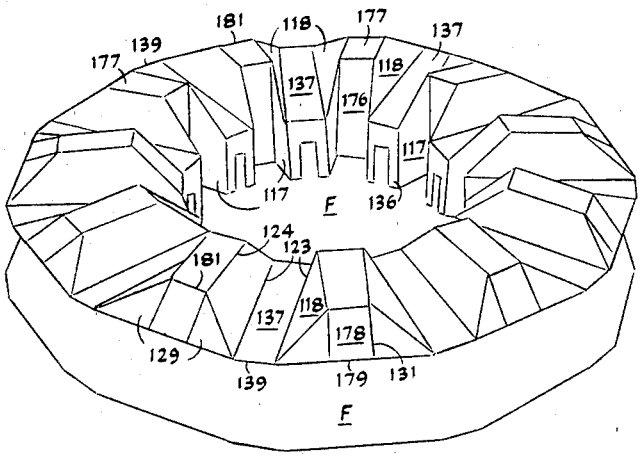
Figure 44:
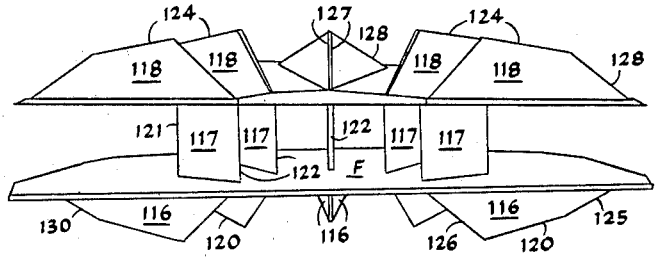
FIGS. 44 to 47 are views of a radial, sectorial structure made from a blank like that of FIG. 37.
Figure 45:
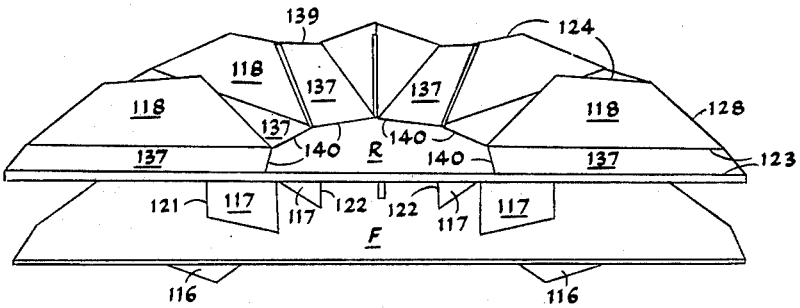
Figure 46:
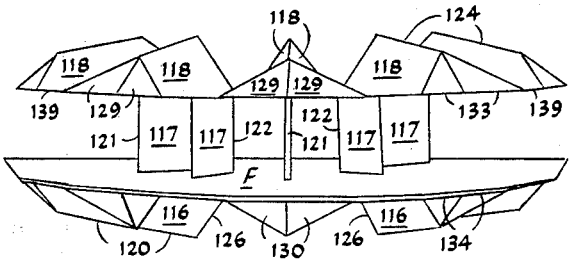
Figure 47:
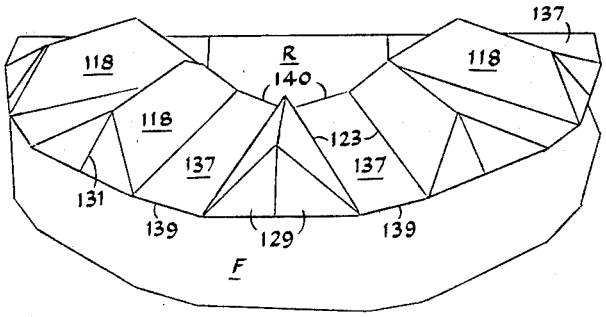

FIGS. 41,42 and 43 illustrate an arrangement in which there is a row of trapezoid-separating rectangles on both sides of each row of trapezoids 118,117,116. It will be apparent that there are two sets of files of rectangles. One set (files 137,136,135) is like those previously described. The other set (files 177,176,175) has the effect of providing (a) intervening flat tops 177 (FIG. 42) at the upper ridge-forming short bases 124 of the upper trapezoids 118 (b) corresponding intervening flat bottoms 175 of the downwardly projecting supports formed by the short bases 120 of the lower trapezoids 116 and (c) intervening flat vertically arranged flat panels 176 at the outer edges formed by the long bases 121 of middle trapezoids 117. In addition these latter rows of rectangles may include rectangles 178 and 174 which intervene between pairs of triangles 129,129 and 130,130. The result may be viewed as a flattening of all angles at ridges and valleys as well as at edges of core-forming vertically arranged trapezoids. Also shown is a variation in which, instead of cutting out all of a middle rectangle, only part thereof is cut out (in 136) so as to form a restricted doorway to the core area. It will be understood that one may form structures that are not radially symmetrical (e.g. structures having the general appearance, in plan view, of a sector of a circle, or more properly, of a sector of a polygon) by using fewer rows of the elements (and not joining the blanks end-to-end). Thus the "semi-circular" structure shown in FIGS. 44,45,46, and 47 is essentially one half that shown in FIGS. 37,38 and 39. Any suitable means may be employed for stably securing the elements together in their unfolded condition; this securing function is served, for instance, by a flat central roof R attached to the inwardly disposed edges of the elements of the canopy portion and a floor F resting on the base portion and serving to keep the upstanding elements 117 in predetermined spaced relationship.

Figure 48:
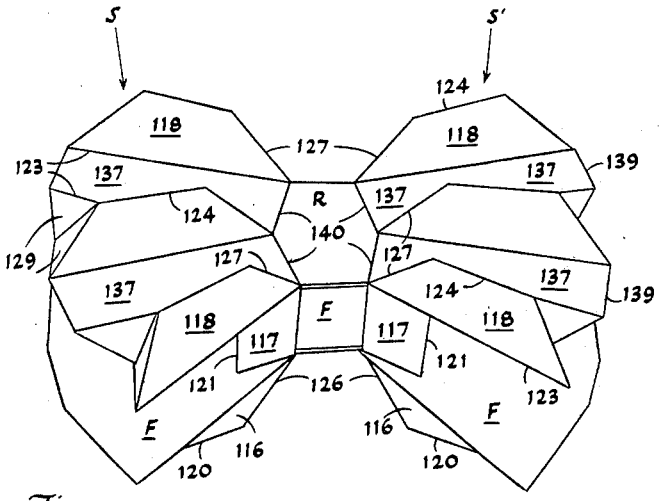
FIGS. 48 and 49 are views of another radial, sectorial structure, made by joining two smaller arcuate structures.
Figure 49:
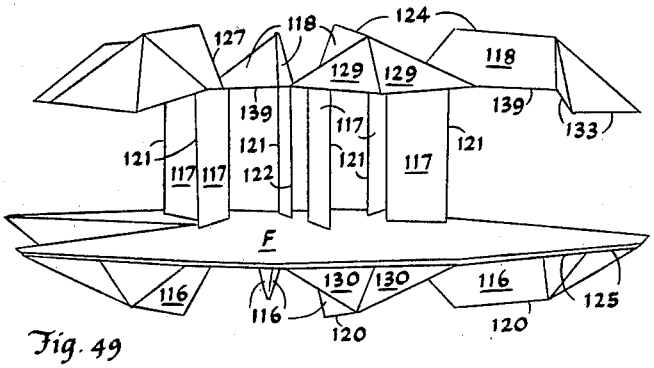

Combinations of such sectorial-type structures may be produced. One such embodiment is shown in FIGS. 48 and 49, formed of two identical sectorial-type structures S and S' joined at their narrow sides by a roof R and floor F. Each of the structures S and S' is formed of the same elements as in FIGS. 44–47 except that fewer rows are used, so that each structure fans out only about 90° instead of about 180°.

Figure 50:
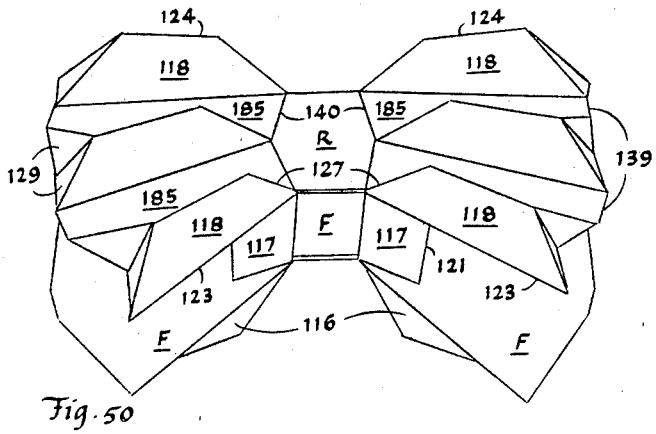
FIG. 50 shows a structure like that of FIGS. 48 and 49, using other trapezoid-separating elements.

The trapezoid-separating elements need not be rectangular. Thus in FIG. 50 (which shows a structure otherwise identical to FIG. 48, the horizontally disposed trapezoid-separating elements 185 are roughly trapezoidal themselves, being narrower at the outer, longer, circumference (at 139) and wider at the inner core (at 140).

Figure 51:
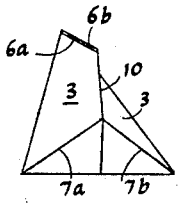
FIG. 51 is a view of a ridge showing the relationship which results in warping of trapezoids of the structure.
Figure 52:
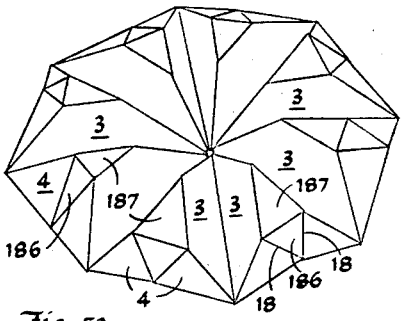
FIG. 52 is a view of a radial structure in which there are gores to reduce the warping.
Figure 53:
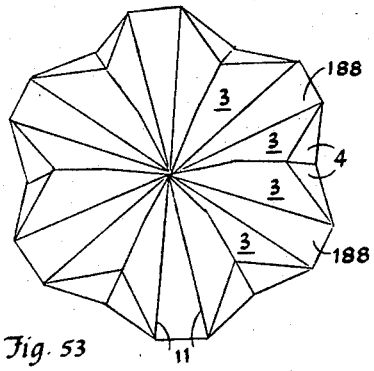
FIGS. 53 and 54 show structures in which triangular separating elements are employed.
Figure 54:
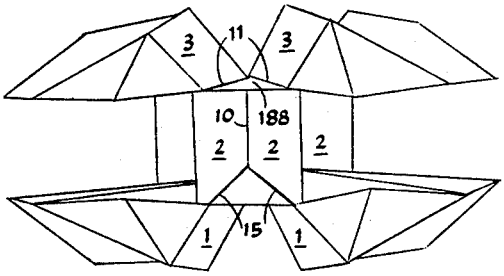

In all the structures described so far the various originally parallel identical trapezoidal elements are placed in non-parallel relationship. This can be seen in FIG. 51 (which illustrates a portion of the structure shown in FIGS. 2 and 7), for instance, by considering two adjacent upper trapezoids 3, having A-sides 6*a*, 7*a* and 6*b*, 7*b*, and a common short base 10. In FIG. 51 the A-sides 6*a* and 6*b* are brought into substantial coincidence and are both in the same plane as the common short base 10, but the other A-sides (7*a* and 7*b*) are flared outward from the outer-end of that short base 10. As a result the upper trapezoids 3 are in a warped, stressed non-planar smooth-curved condition, to a greater or lesser degree. The same is true of the lower trapezoids 1. It is contemplated that the materials of construction of the trapezoids (e.g. thin metal such as aluminum or fiber glass-reinforced sheets, cardboard, etc.) will be flexible enough to accommodate such warping. If desired the construction may be such as to diminish, or avoid, the warping, as by using triangular gores 187 illustrated in FIG. 52) and appropriate panels 186 to substitute for or modify, the end triangles; this introduces additional connections or hinges and additional panels, and increases the expense. Other arrangements such as use (FIGS. 53,54) of outwardly flaring triangles, to separate trapezoids 3 and 1, of the upper and lower sets, may be employed (in FIG. 53 this enables use of less trapezoids per set to form the radially symmetrical structure). It will also be understood that the separations such as elements 137 and 177 in FIG. 43 need not be rectangular but may be tapered to flare outwardly, thereby reducing the warping.

Figure 12:
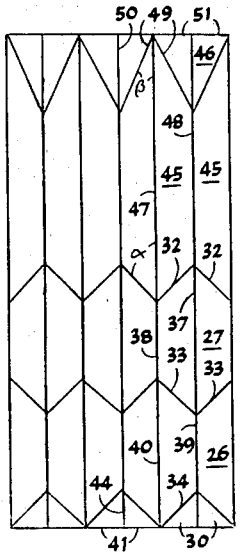
FIG. 12 shows part of still another blank.
Figure 13:
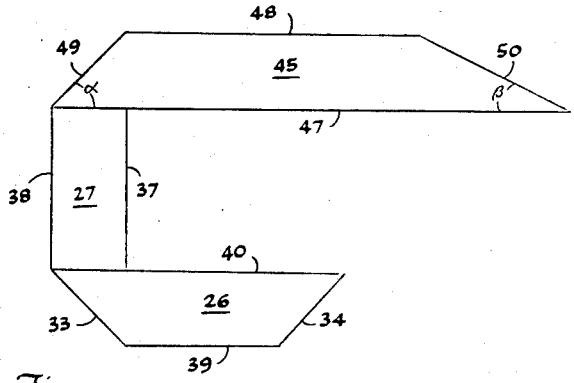
FIG. 13 shows how it is folded and FIGS. 14–15 show the corresponding radial structures.
Figure 14:
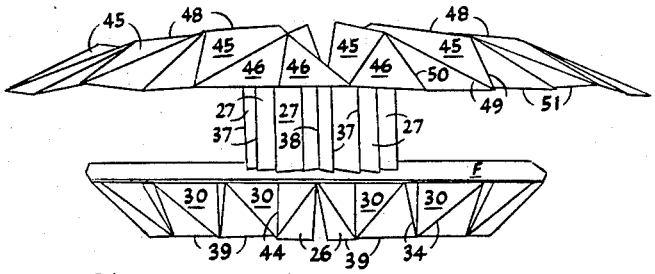
Figure 15:
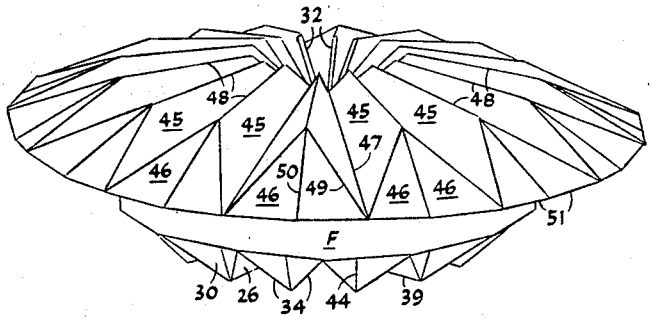
Figure 55:
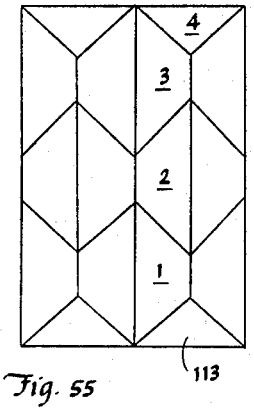
FIGS. 55–55C are details showing alternative arrangements at the edges of the structure.
Figure 55A:
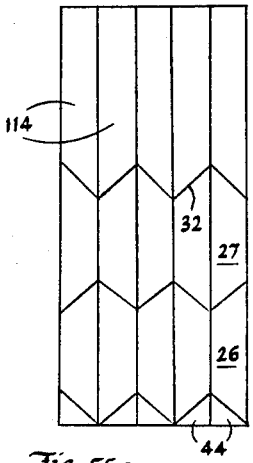
Figure 55B:
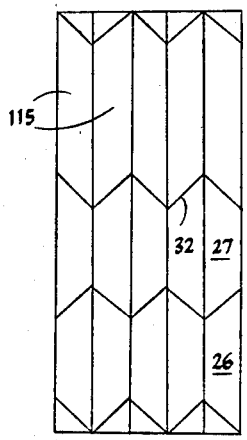
Figure 55C:
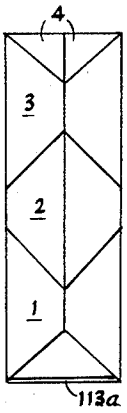

The illustrated structures have pairs of triangular elements at the free ends of the upper and lower trapezoids (e.g. elements 5 and 4 in FIGS. 2,3,4–7,20,21,25,26,27,28, and 40; elements 29 and 30 in FIGS. 8,9,10 and 11; elements 46 and 30 in FIGS. 12,13,14 and 15; elements 59 and 60 in FIGS. 16,17,18,19,22 and 23, elements 84,85 in FIG. 24; elements 129,130 in FIGS. 29–33,37,38,39,41–50; elements 149,150 in FIGS. 34,35 and 36). As indicated earlier the use of such pairs of triangles constitutes one convenient way to fill in the spaces at the free ends of the trapezoids, but those spaces may be filled in as well by single triangles such as 113 (as shown in FIG. 55) or may be left unfilled particularly when the spaces between the free ends of those trapezoids are maintained by other suitable means such as the elements 113*a* (FIG. 55*c*), which may be struts (acting in compression and/or tension, or tensiond elements such as cables or guy wires. As shown in FIG. 13, for instance, the angle $\beta$ at the free ends of the upper and/or lower trapezoids may be different from the angle $\alpha$ at the opposite end; other angles $\beta$ are shown in FIG. 55A (90°) and FIG. 55B (obtuse and, if desired, the complement of $\alpha$ so that the A-sides are parallel).

It will be noted that when the trapezoids are warped the opposite bases of a warped trapezoid may no longer be parallel, e.g. the long base may be horizontal while the short base is at a small angle to the horizontal. Thus the ridges 14 of the base portion shown in FIGS. 5 and 6 tilt upward, so that (if the structure is resting on relatively firm ground) the support may be mainly at the lowermost, inward, portions of those ridges, i.e., at point 24; the rigidity provided by the interaction of the elements of the structure makes it strong enough to carry a considerable weight substantially on those points.

Figure 56:
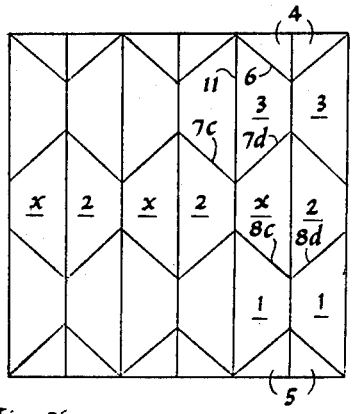
FIG. 56 shows a portion of a blank like that of FIG. 2 but with portions (marked "X") eliminated.
Figure 57A:
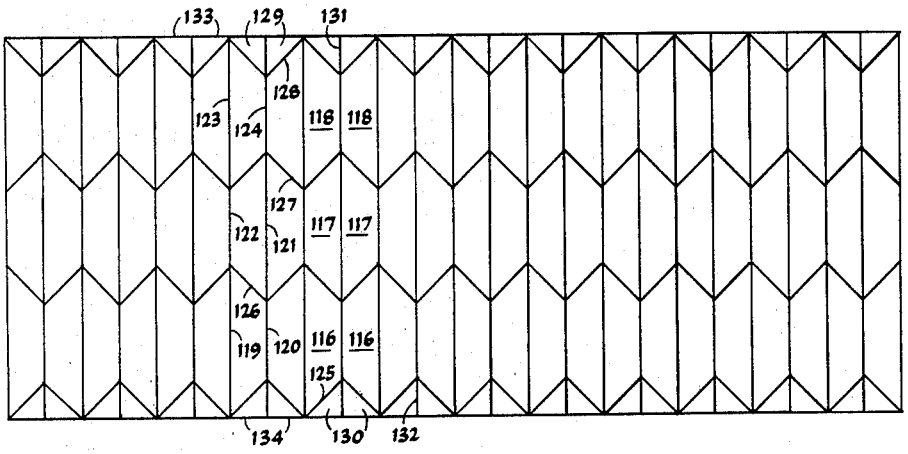
FIG. 57A shows a blank and FIGS. 57–59 show an arcuate structure made therefrom.
Figure 57:
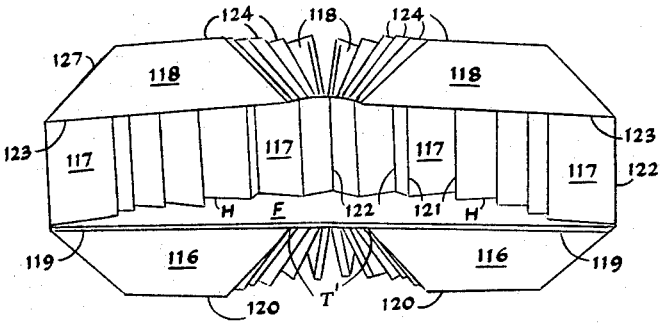
Figure 58:
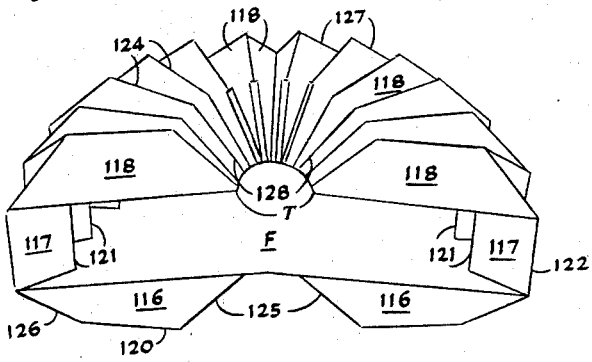
Figure 59:
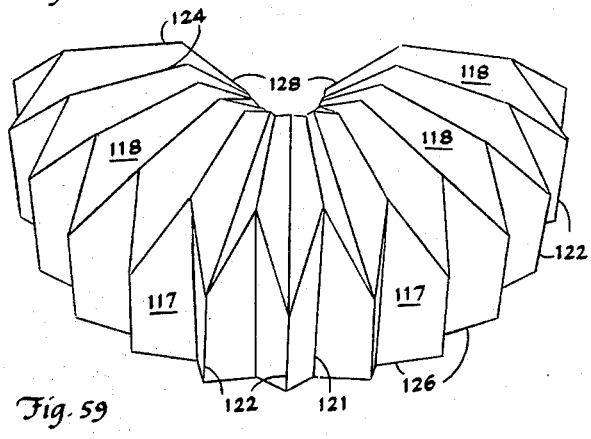

In many of the structures previously discussed there are portions in which paired elements are doubled-up face-to-face. For instance, in the structure shown in FIGS. 5 and 6 each pair of middle trapezoids 2 having common long bases 13, has its paired trapezoids in face-to-face relationship. To save material one of the trapezoids of all (or some) of such pairs may be eliminated in each of these structures. Thus, in the (portion of a) blank illustrated in FIG. 56 half (marked "X") of the middle trapezoids 2 are omitted; in making the structure of FIGS. 5–7 from such a blank the A-sides 7*c* and 7*d* are secured together as are the A-sides 8*c* and 8*d*. In the oppositely unfolded structure such as those of FIGS. 57–59 there are pairs of triangles 5 and 4 (see FIG. 2) which are doubled-up and located under the inwardly projecting A-sides 9 and 6 of upper and lower trapezoids 3 and 1; those triangles may be eliminated entirely and those A-sides (of adjacent trapezoids having common short bases) may be secured together.

Figure 4:
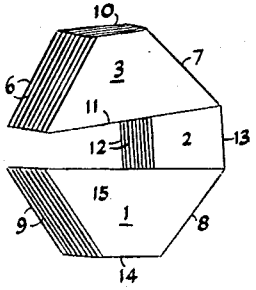
FIG. 4 shows a portion that folded blank in collapsed condition.

One way of making other structures is to unfold the blank from its collapsed position (e.g. a position like that in FIGS. 3 and 4, in the opposite direction; that is, the unfolding is such as to separate the edges 122 (i.e. the short bases of the middle trapezoids) instead of keeping them together, and (conversely) to keep together the edges 121, which are the long bases of the middle trapezoids. This converts the folded blank into an arcuate structure such as the semicircular structures shown in FIGS. 57–59 made from the blank shown in FIG. 57A. In that structure the short bases 122 of trapezoids 117 form the outer ridges of the semicircular arc and their long bases 121 project inwardly substantially radially of that arc. The upper trapezoids 118 also project radially inwardly and their end A-sides 128 may be secured together in pairs, that is, the pair of triangles 129 adjacent those end A-sides 128 may be brought face-to-face so that those end A-sides meet (it will be understood that in such a case the triangles 129 are essentially superfluous and may be eliminated from the structure). The tips T of the long bases 123 of the inwardly projecting upper trapezoids 118 may be brought together in a semi-circular internal ring. The same arrangement may be used for the radially projecting lower trapezoids 116 so that pairs of adjacent end A-sides 125 thereof are joined (triangles 130 being eliminated as superfluous) and the tips T' of the long bases 119 are brought together in the same type of semi-circular internal ring. A floor F may be supported on the long bases 119 of the lower trapezoids; also a ceiling may be positioned against the long bases 123 of the upper trapezoids. Various securing means may be used to stabilize the structure. For instance the degree of unfolding about the inwardly projecting long bases 121 of the middle trapezoids may be fixed, as by having the floor fit into the triangular inwardly directed spaces H between the middle trapezoid. It will be understood that the final configuration need not be semicircular; the structure may be unfolded to a greater extent, e.g. 270° or even 360° (with addition of trapezoids to each set); in the latter case a fully enclosed structure is formed and one or more of the elements 117 may have appropriate cutouts to serve as windows and/or doorways.

Figure 16:
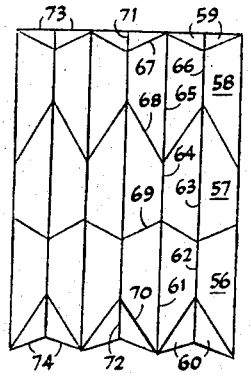
FIG. 16 shows part of a blank having asymmetrical trapezoids.
Figure 17:
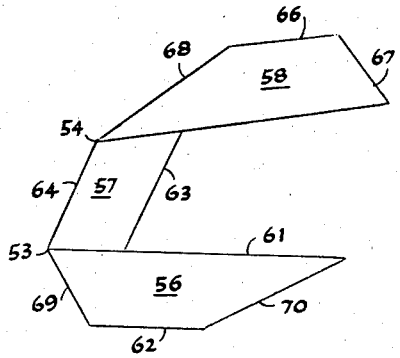
FIG. 17 shows how it is folded and FIGS. 18–19 show the corresponding radial structures.
Figure 18:
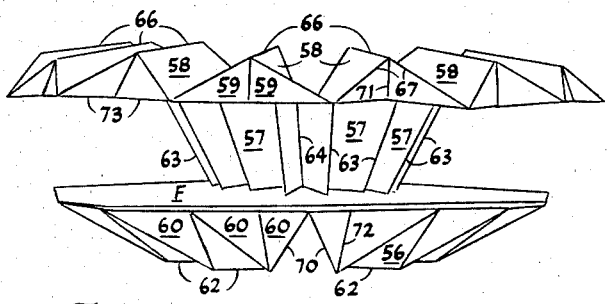
Figure 19:
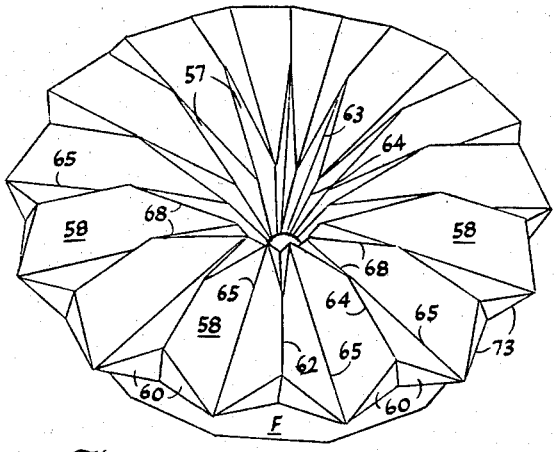
Figure 60:
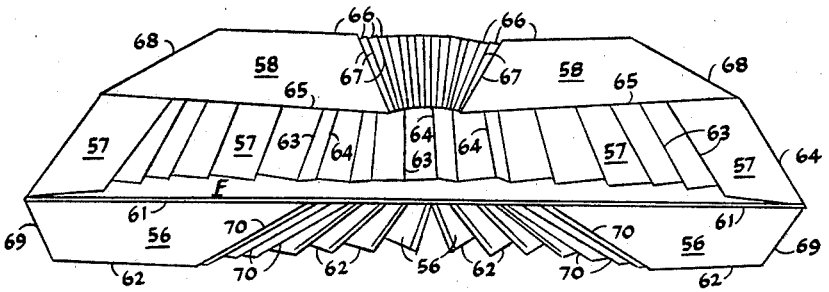
FIGS. 60, 61 and 62 illustrate a similar arcuate structure made from a blank shown in FIG. 16.
Figure 61:
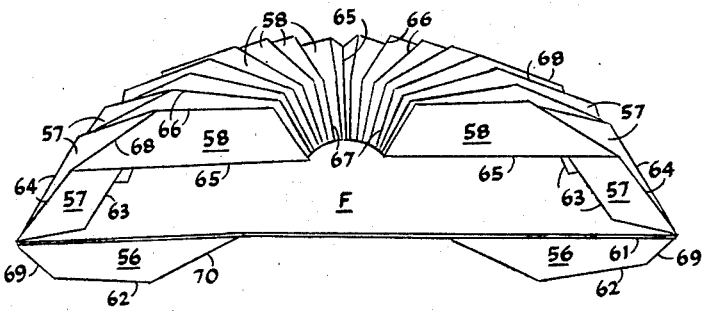
Figure 62:
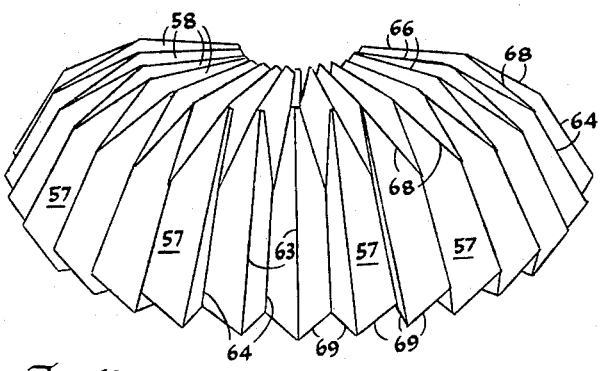

FIGS. 60,61 and 62 illustrate a similar arcuate structure made from the blank shown in FIG. 16. It will be seen that the middle trapezoids form an inwardly flaring ring in this arrangement.

Figure 63:
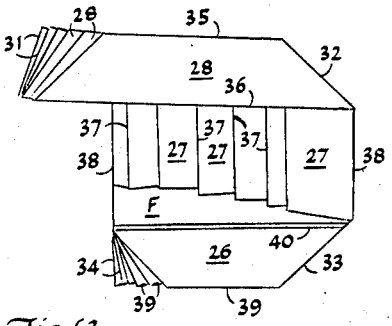
FIGS. 63, 64 and 65 show other arcuate structures made from different blanks.
Figure 64:
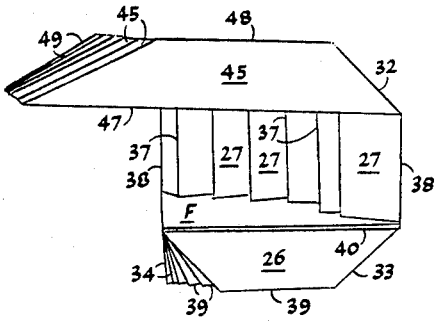
Figure 65:
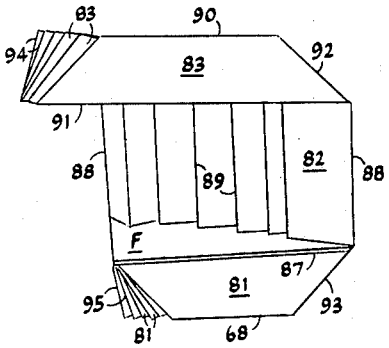

It will also be understood that the relative lengths of either (or both) of the upper and lower trapezoids may be increased so as to reduce the radius of the arcuate internal ring to any desired degres so that the canopy overlies (and/or the base portion underlies) substantially the whole floor area. FIGS. 63,64,65 illustrate lengthening of the upper trapezoids (using blanks like those shown in FIGS. 8,9; FIGS. 12,13 and FIG. 24, respectively.

Figure 66:
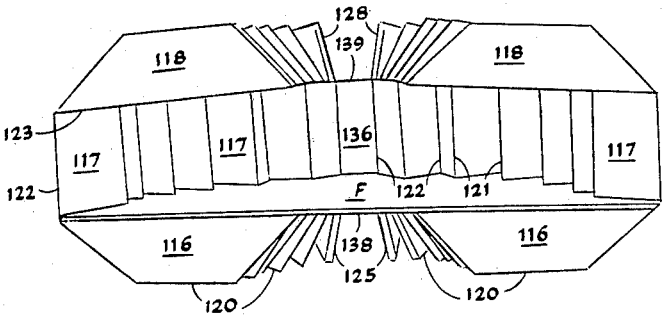
FIGS. 66 and 67 show another arcuate structure made from a blank like that of FIG. 29.
Figure 67:
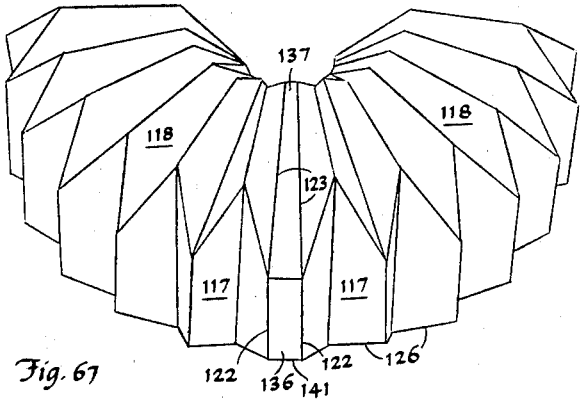

As in the case of the structures in which there are no separating elements between trapezoids, the structures having such elements may be unfolded with the middle, upstanding, trapezoids at the outer periphery rather than at the inner core. FIGS. 66 and 67 illustrate one such embodiment, in which a blank with trapezoids like that of FIG. 29 is unfolded in the manner shown in FIGS. 57–59.

It will be understood that a warping of the upper and lower trapezoids, similar to that previously described, occurs (in an opposite direction) in the constructions in which those trapezoids are directly inwardly rather than outwardly (as in FIGS. 57–59, 60–62, 66–67).

Figure 68:
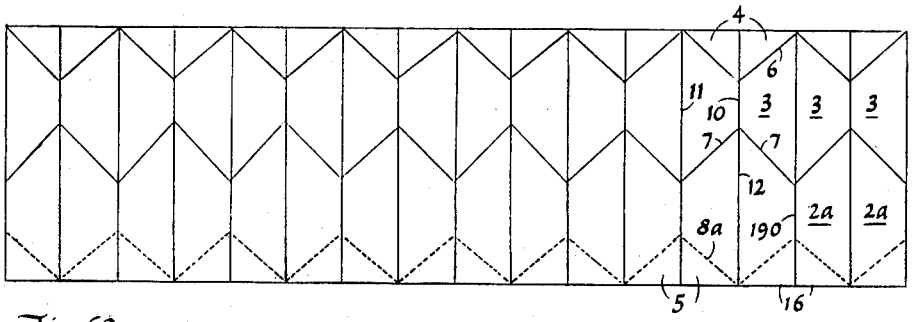
FIG. 68 shows a blank having only two sets of trapezoids.
Figure 69:
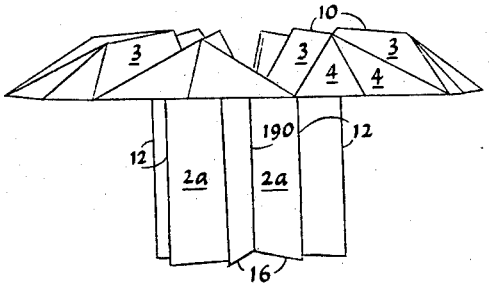
FIGS. 69 to 71 and 73 show radial structures made with two sets of trapezoids and FIG. 72 shows a portion of a blank used to make FIGS. 71 and 73 having two sets of trapezoids and rectangular separations.
Figure 70:
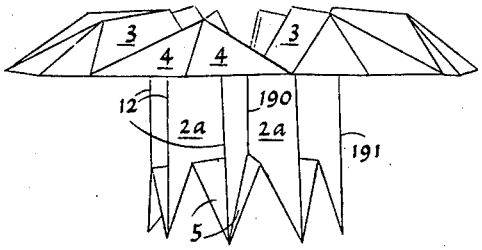
Figure 71:
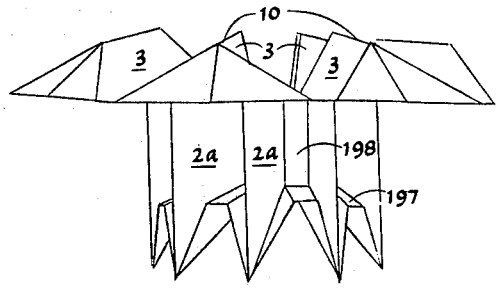
Figure 72:
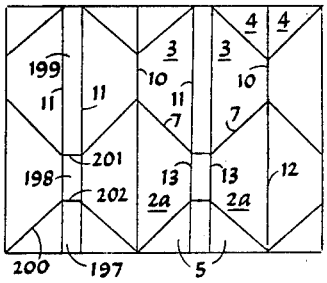
Figure 73:
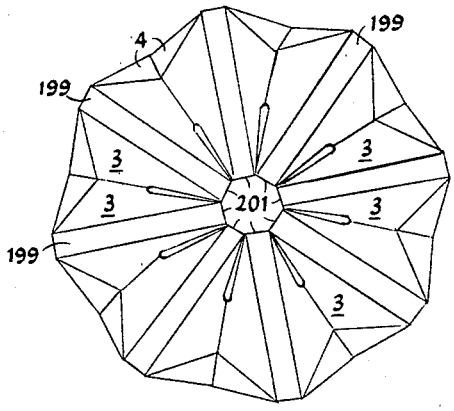

The structures described above have a base portion, a columnar support portion and a canopy portion. Simpler structures may be created without a base portion. Thus the blank (FIG. 68) may be composed of column-forming trapezoids 2A and canopy-forming trapezoids 3 (and filler triangles 5, if desired). Also, the column-forming trapezoids 2A may have lower sides perpendicular to their bases as in FIG. 69 or may be folded diagonally to form edge triangles as in FIG. 70. The structure may be made with trapezoid-separating elements such as the rectangular elements 199,198,197 shown in FIGS. 71 to 73. The blank may be unfolded just like any of those previously illustrated except that the lower parts of the column-forming trapezoids are secured to a suitable foundation (they may be secured like posts in the ground) or stand on the points of the long bases 12.

Figure 74:
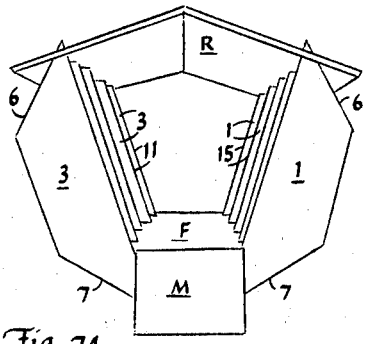
FIGS. 74 and 75 show a rectilinear structure made from a blank as in FIG. 2
Figure 75:
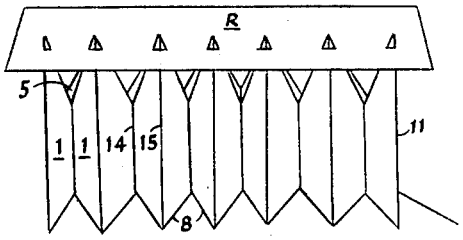
Figure 76:
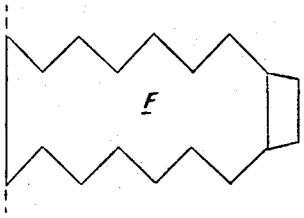
FIG. 76 illustrates a floor shape.
Figure 77:
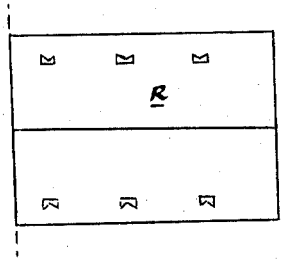
FIG. 77 illustrates a roof shape.

In making the structures described above the blanks are unfolded in a curvilinear path. The unfolding may also be rectilinear. One such embodiment is illustrated in FIGS. 75 and 74 in which the middle trapezoids (concealed by the ramp M in FIG. 74 are positioned at the bottom; i.e., the structure shown in FIG. 3 is turned on its side, so that the short bases of the middle trapezoids rest on the ground while their long bases serve as supports for the floor F. The floor and roof may be of any suitable construction and may, if desired, be of such configuration as to stabilize the final structure. For instance, the floor F may be shaped as in FIG. 76 to fit into the triangular spaces between adjacent pairs of trapezoids 3 and 1 and the roof R may be shaped as shown in FIGS. 74, 75 and 77 and have means (such as suitably shaped openings as illustrated) to interlock it with the tops of the upstanding trapezoids 3 and 1. Instead of using pairs of triangles 5 to fill the spaces between the upper A-sides, as illustrated in FIG. 75, those spaces may be filled in any other suitable manner or those upper A-sides may be suitably shaped without any intervening filling as shown in FIG. 55A (in which those A-sides are at 90° to the bases).

It will be noted that, even though in the folded blank (FIG. 3) the trapezoids 3 and 1 are substantially parallel, they are at an angle in the extended configuration illustrated in FIGS. 74 and 75. This divergence from parallelism increases if the folded blank is unfolded rectilinearly to a greater degree, and vice versa (thus, if the unfolding process is carried to its ultimate limit so that the folded blank of FIG. 3 is completely unfolded back to the position shown in FIG. 2, the trapezoids 3 and 1 of course become aligned with middle trapezoids 2, rather than at an angle thereto).

Figure 78:
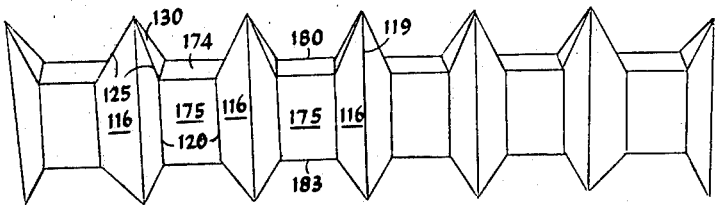
FIGS. 78 and 79 show one rectilinear structure having some rectangular elements and FIG. 80 shows another such structure.
Figure 79:
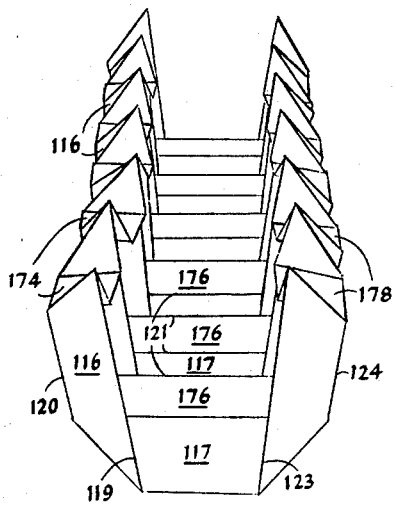
Figure 80:
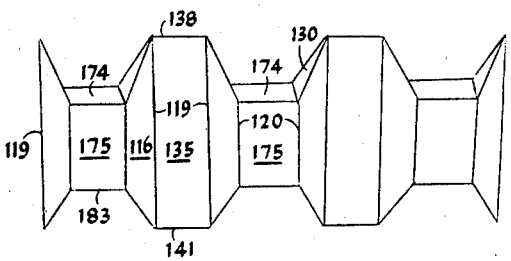
Figure 82:
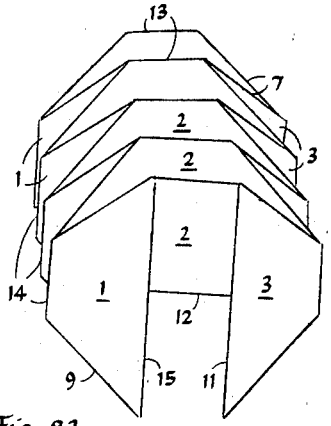
FIGS. 81 to 88 show rectilinear structures having their middle sets of trapezoids uppermost.

The rectilinear structures may be modified by the use of trapezoid-separating elements (e.g. rectangles as previously described). FIGS. 78 and 79 illustrate one such embodiment in which larger compartments 174,175,176 and 177,178, are each formed from pairs of upper, middle and lower trapezoids 118,117,116 and associated triangles 129,130, and these are connected by a rectangular passage formed from intervening rectangular separations 175, etc. Another such embodiment is formed in FIG. 80 from a blank like that shown in FIG. 41 and comprises a series of compartments joined through rectangular passages formed from wider rectangular passages formed by rectangle 178,177,176,175,174 and narrower rectangular passages formed by 137,136,135.

Figure 85:
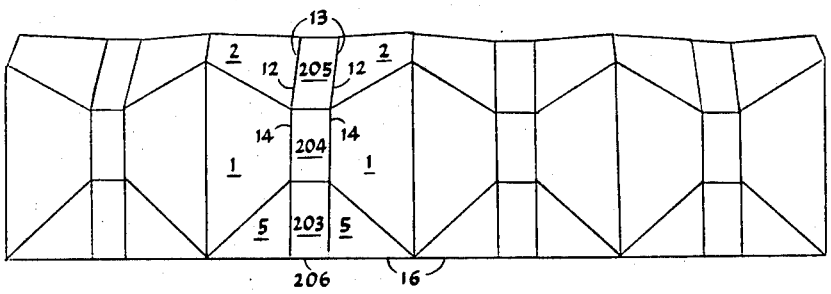
Figure 86:
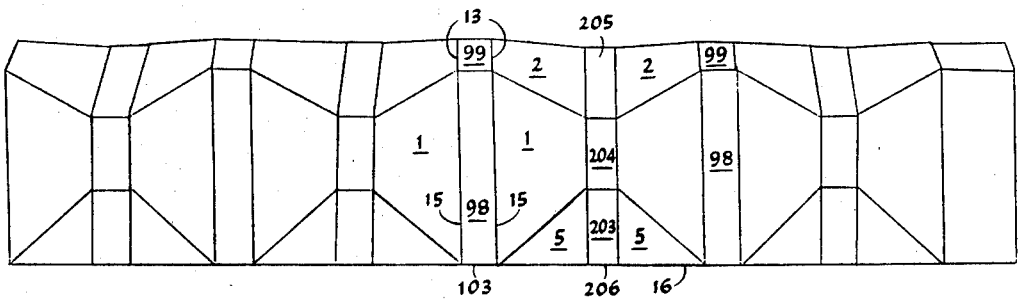
Figure 87:
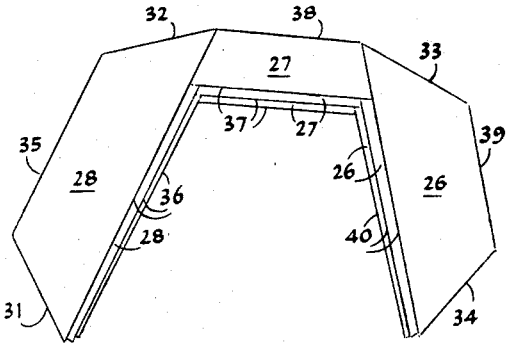
Figure 88:
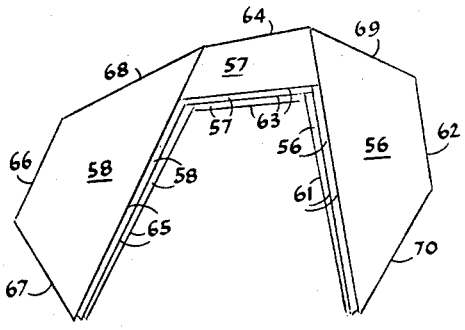
Figure 89:
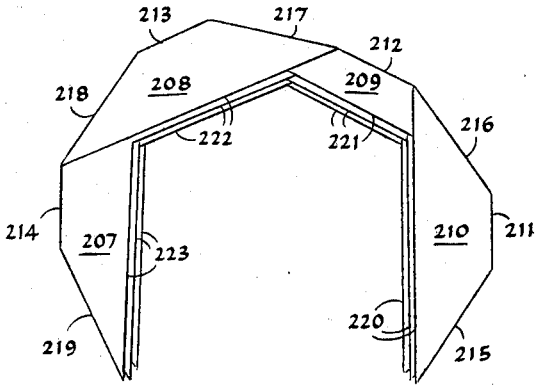
FIGS. 89 and 90 show rectilinear structures having four sets of trapezoids.
Figure 90:
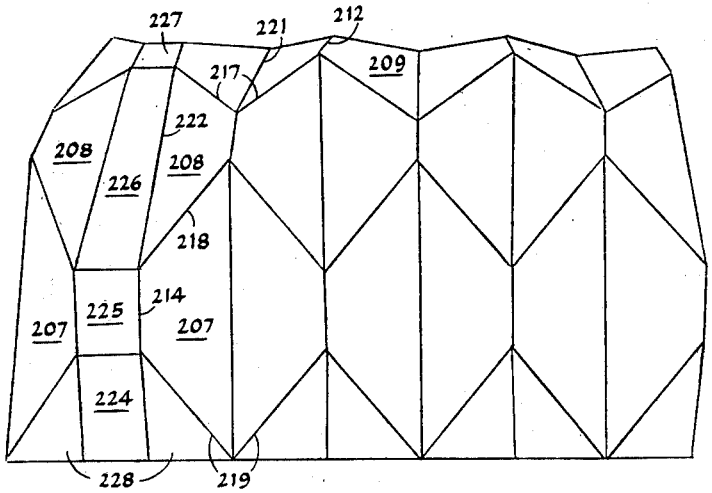

As illustrated in FIGS. 81–85, the rectilinear structures may also be formed with the middle trapezoids uppermost, again using the upper and lower trapezoids (such as 3 and 1) as supporting structures. While these upper and lower trapezoids are illustrated as having pointed ground-engaging free ends spaced by pairs of triangles 5 (and 4) which are folded in, it will be understood that the triangles may be folded in only partially (slightly) so that their outer edges come into contact with the ground; one may also eliminate these pairs of triangles and replace them by, for instance, single triangles fitting between ground and the adjacent A-sides or one may use upper and lower trapezoids in which the angle is such (as shown in FIG. 55A) that their A-sides engage the ground over substantially the whole length of said A-sides. By increasing the degree to which the structure is unfolded (compare FIG. 84 with FIG. 83) one can increase its length, while lowering its height. Also, the structures can be varied by using sets of trapezoids of different length and/or asymmetrical trapezoids (see FIG. 87 made from a blank like that shown in FIG. 8; and FIG. 88, made from a blank like that shown in FIG. 16. As in previously described constructions, trapezoid-separating elements (such as rectangles) may be provided at various positions between adjacent sets of trapezoids and triangles. In FIG. 85 a set of 5 rectangles (three of which are shown as 203,204,205) is positioned (like the rectangles 178,177,176,175,174 of FIG. 41) between adjacent pairs of trapezoids. In FIG. 86 there are also shown a set of rectangles (including 98,99, etc.) positioned like those in FIG. 41. Also there may be more than three sets of trapezoids (as in FIG. 89 in which there are four sets 207,208,209,210 having long bases 223,222,221,220, respectively, and short bases 214,213,212 and 211, respectively) and, in such structures (made with more than three sets of trapezoids) there may be trapezoid-separating elements (as shown in FIG. 90, in which there is a file of rectangles including elements 224,225,226,227; in FIG. 90 there are rectangles such as 224 which separate the edge triangles 228 which are present, but not shown in the structure illustrated in FIG. 89.)

Figure 81:
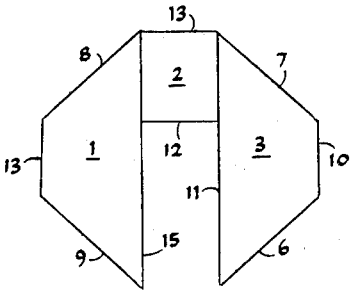
Figure 83:
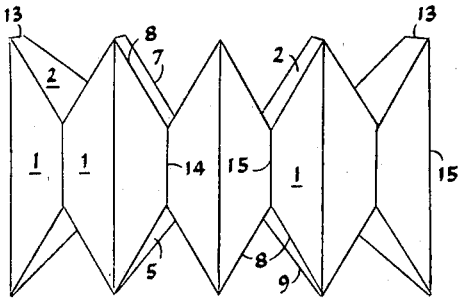
Figure 84:
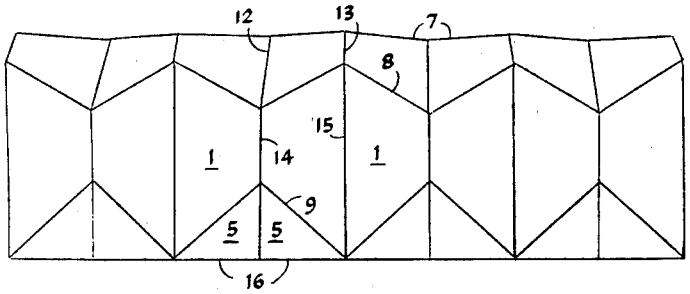
Figure 91:
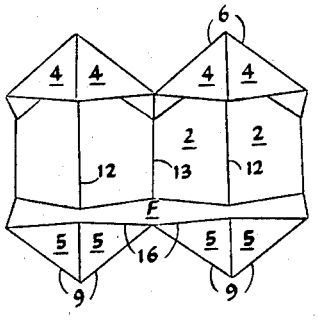
FIGS. 91 to 96 show rectilinear structures in which the middle set of trapezoids are more or less vertical.
Figure 92:
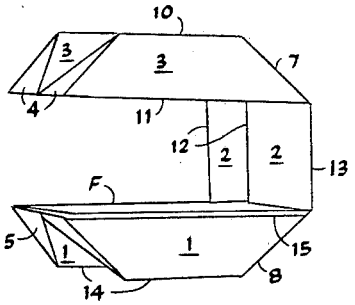
Figure 93:
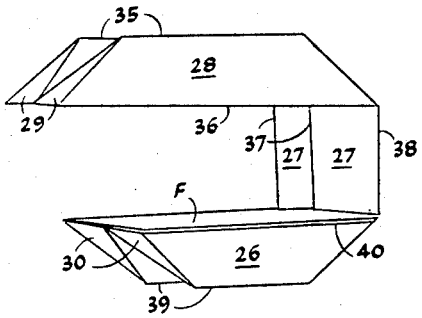
Figure 94:
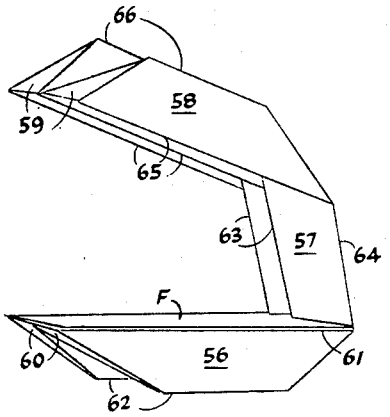
Figure 95:
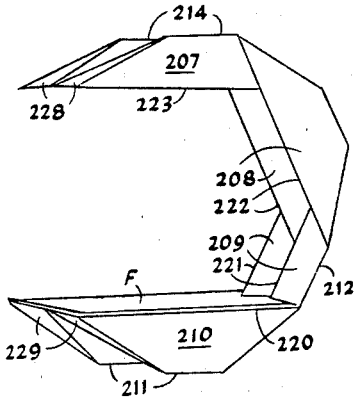
Figure 96:
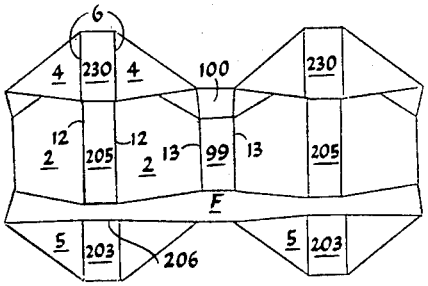

In the description of the rectilinear structures above their middle trapezoids have been more or less horizontal, at the bottom of the structure (as in FIGS. 75 and 74) or at the top (as in FIGS. 81,86). Rectilinear structures in which the middle trapezoids are more or less vertical, so that the structures are open at one side, may also be formed. Thus in FIGS. 91 and 92 the collapsed blank of FIGS. 3 and 4 is unfoled rectilinearly, and a floor F is placed on the long bases 15 of the lower trapezoids 1. In FIG. 93 an extended canopy is formed by employing longer upper trapezoids, using the configuration shown in FIGS. 8 and 9. In FIG. 94 the canopy slopes upward, using the configuration shown in FIGS. 16 and 17. In FIG. 95 the structure is made from four sets of trapezoids, similar to FIG. 89. Trapezoid-separating elements may be used, as in FIG. 96 which employs an arrangement like that in FIG. 41. While only two pairs of trapezoids per set are illustrated (in FIGS. 91 to 96) it will be understood that any number may be used, depending on the length of the structure desired. In each illustration there is a floor, which extends into the angular spaces defined by the middle trapezoids and serves also to stabilize the structure. It will be understood that there may also be a ceiling (whose configuration may be like that of the floor) supported by the upper trapezoids.

Figure 97:
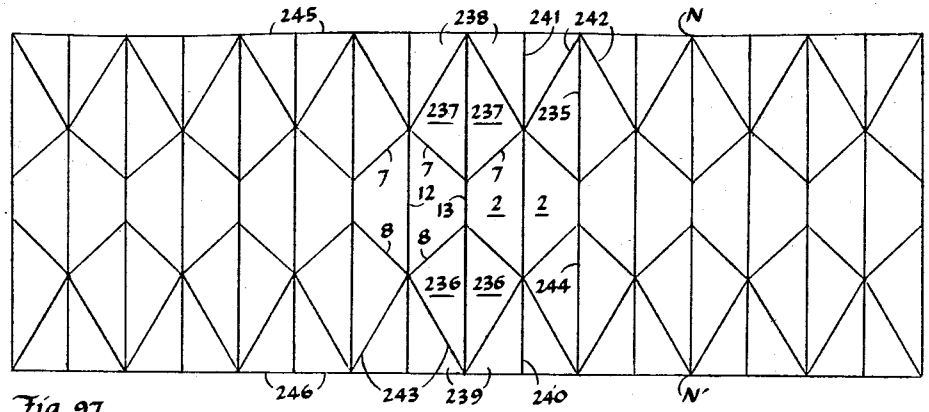
FIG. 97 shows a portion of a blank in which the upper and lower sets of polygons are triangles.
Figure 101:
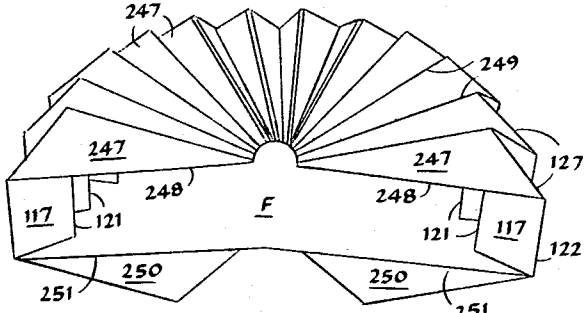
FIGS. 100 and 101 show an arcuate structure made from a blank having upper and lower sets of triangles.
Figure 100:
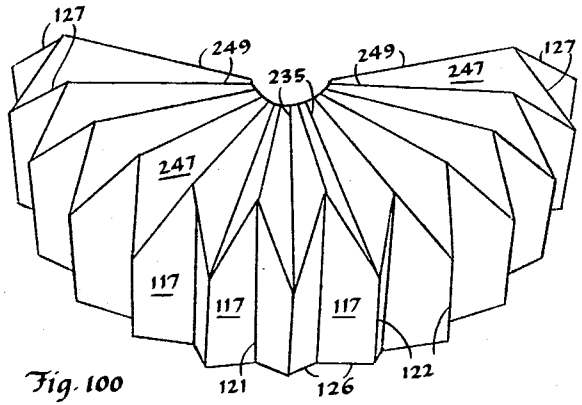
Figure 98:
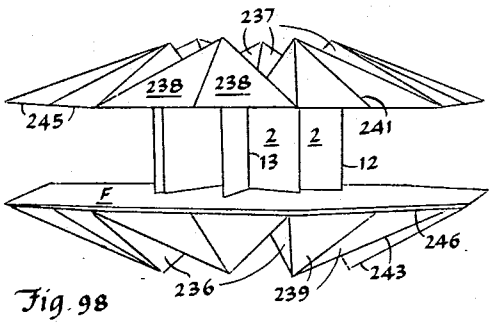
FIGS. 98–99 show a radial structure made therefrom.
Figure 99:
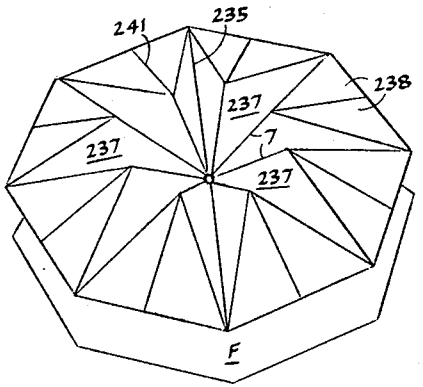
Figure 104:
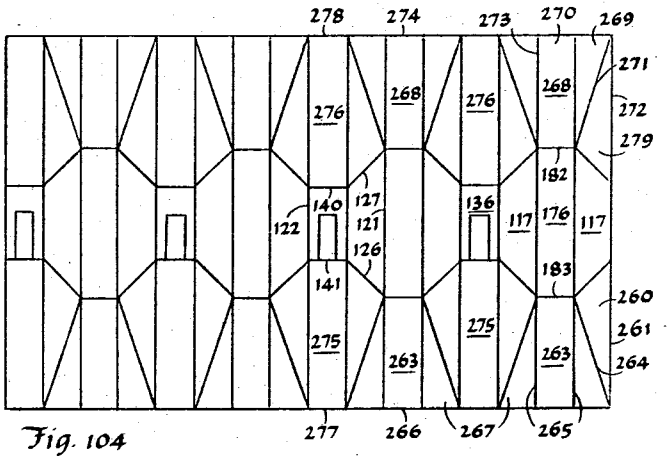
FIG. 104 shows a portion of a blank having triangular elements and rectangular separating elements and FIGS. 105–106 show a radial structure made therefrom.
Figure 106:
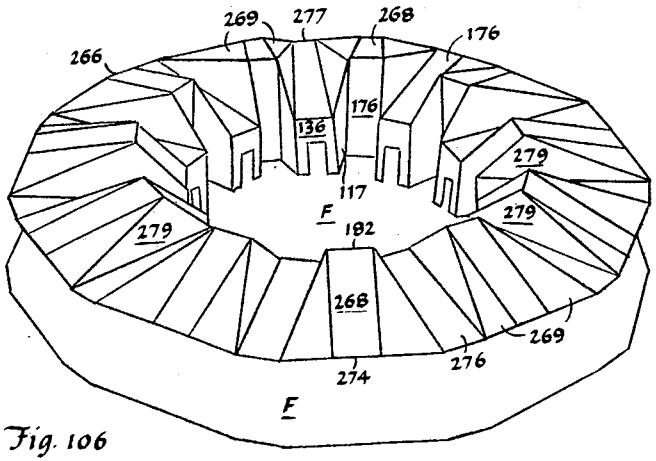
Figure 103:
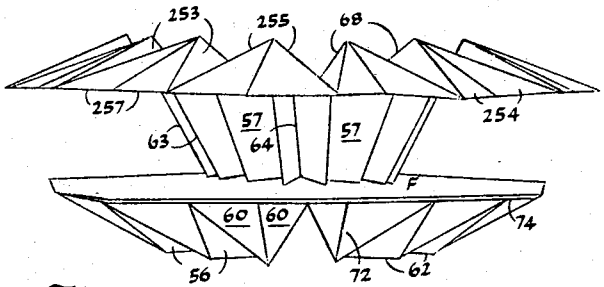
FIG. 102 shows a portion of another blank having a set of triangular elements and FIG. 103 shows a radial structure made therefrom.
Figure 102:
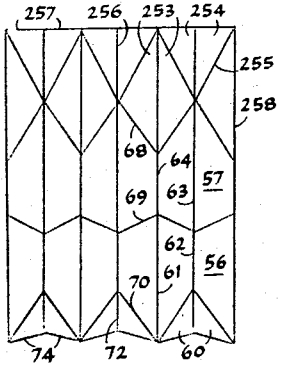
Figure 105:
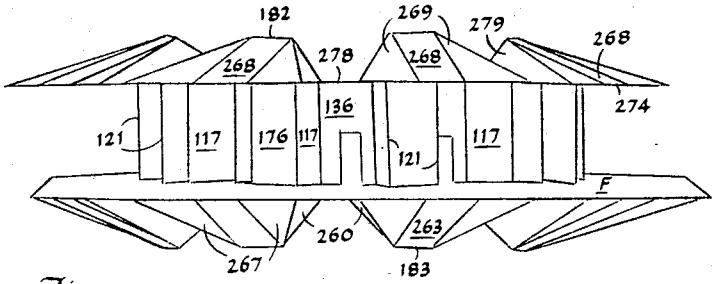

All but one of the sets of trapezoids may be replaced by other elements, e.g. polygons. In FIGS. 97–99 the upper and lower sets of trapezoids have been replaced by sets of triangles 237,236. In each set there are triangles which have one side 244 or 235 in common with an adjacent triangle of the same set and (opposite that common side) one apical point N or N' in common with another adjacent triangle of the same set. The triangles 237,236 interfit with the set of trapezoids; two vertices of the triangles 236 coicide with the lower vertices of the trapezoids 2 and two vertices of triangles 237 coincide with the upper apices of the trapezoids. This arrangement may be formed into a radially symmetrical structure (FIGS. 98 and 99) like that shown in FIGS. 5–7 or unfolded in the opposite direction to form an arcuate structure such as the semicircular structure shown in FIGS. 100 and 101, or into rectilinear structures (not shown) like those of FIGS. 74 and 75, 78–80, 82–84. It will be noted that the triangles may be essentially flat and unwarped even in the radially symmetrical and arcuate structures. It will be understood that variations of lengths, altitudes, angles, etc. may be made (like those discussed above in connection with the configurations made with a plurality of sets of trapezoids). It will also be understood that there may be a plurality of sets of trapezoids with a single interfitting set of triangles (e.g. a middle and a lower set of trapezoids may have an interfitting upper set of triangles as shown in FIGS. 102 to 104; or a middle and an upper set of trapezoids may have an interfitting lower set of triangles). As with the structures made with a plurality of sets of trapezoids, the triangle-trapezoid arrangements may have triangle-separating and trapezoid-separating elements; this is illustrated in FIGS. 104–106 in which there are sets of rectangular separating elements 276 and 268 between triangles 279 of the upper set and similar rectangles 275 and 263 between triangles 260 of the lower set.

Figure 107:
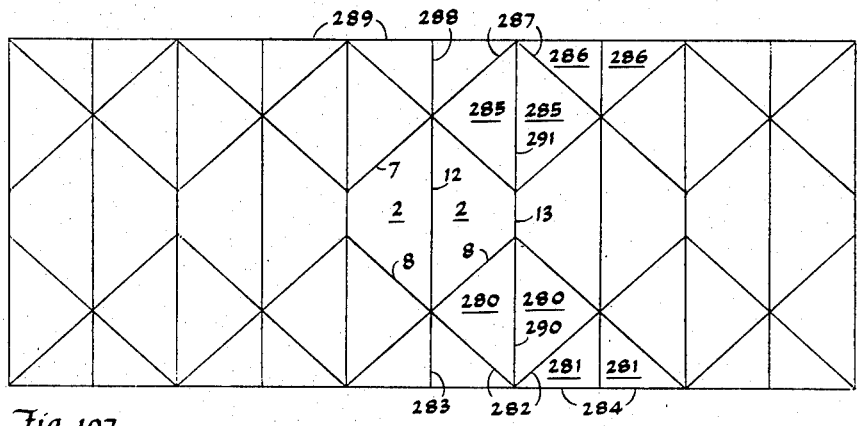
FIGS. 107 to 112 show blanks and structures in which the triangular elements are isosceles.
Figure 108:
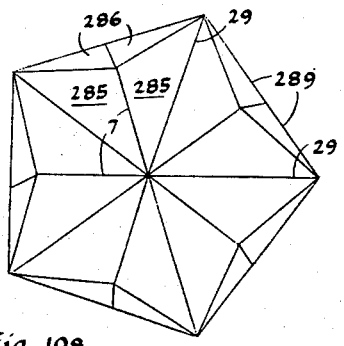
Figure 109:
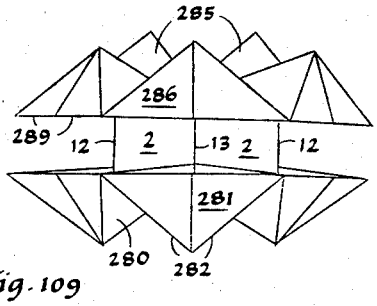
Figure 110:
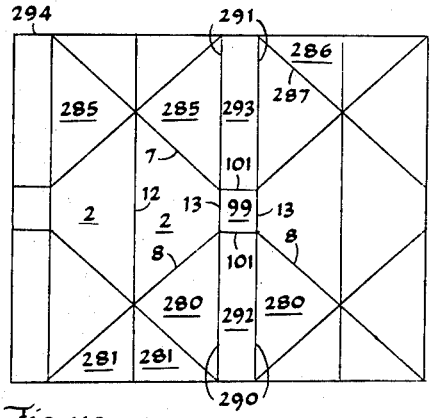
Figure 111:
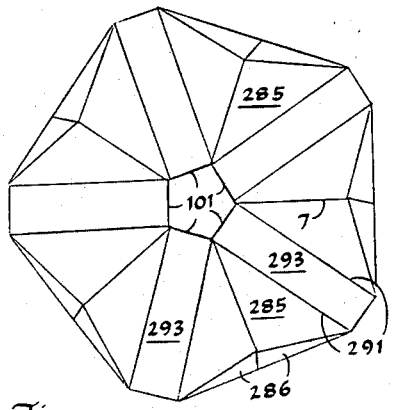
Figure 112:
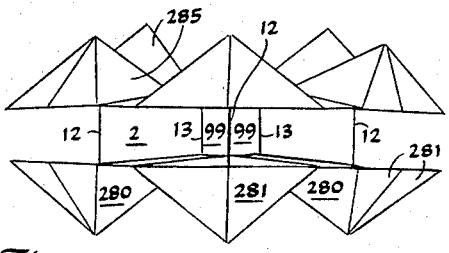

If desired the triangles of either the upper or lower set, or both, may be isosceles triangles as illustrated in FIGS. 107–109. These may be separated by rectangles as in FIGS. 110 to 112.

Figure 113:
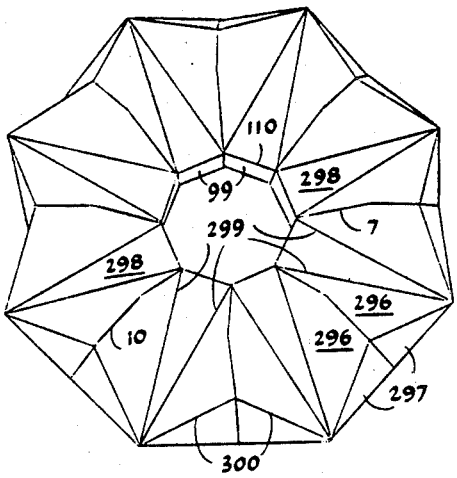
FIG. 113 shows a radial structure made from a blank (partly drawn in FIG. 114) having a set of trapeziums.
Figure 114:
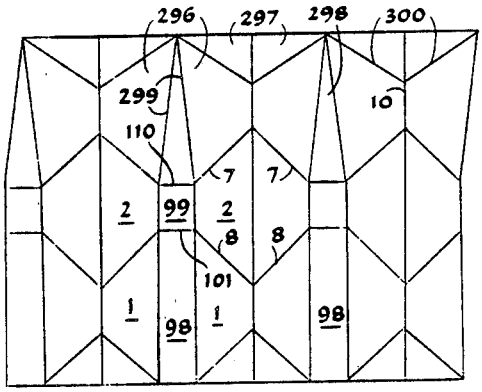
Figure 115:
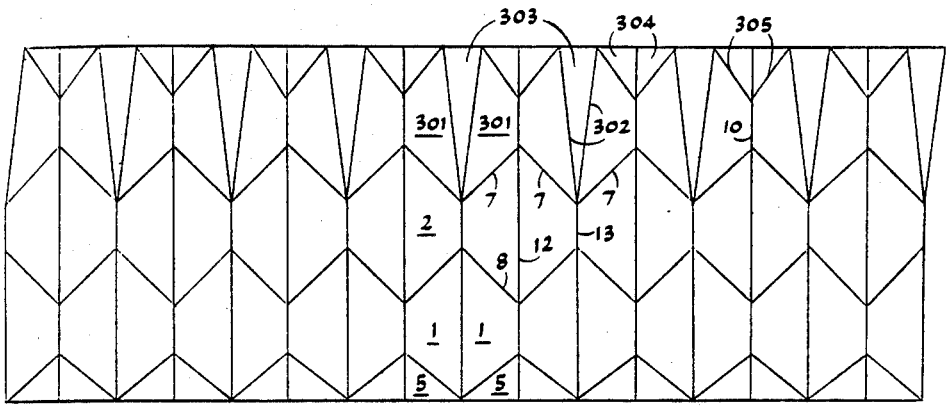
FIGS. 115, 118 and 123, 125, 126 illustrate other blanks having trapezium elements.
Figure 117:
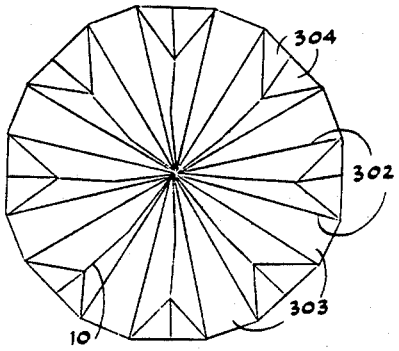
FIGS. 116–117 show a radial structure made from the blank of FIG. 115, FIGS. 119–120 show a radial structure made from the blank of FIG. 118.
Figure 116:
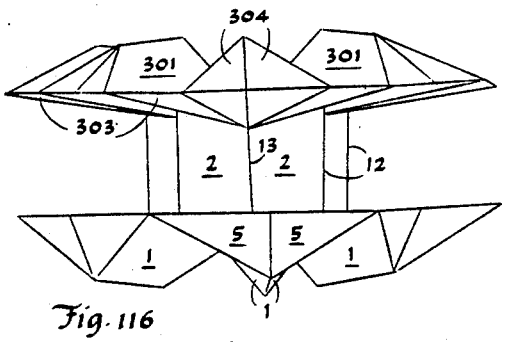
Figure 118:
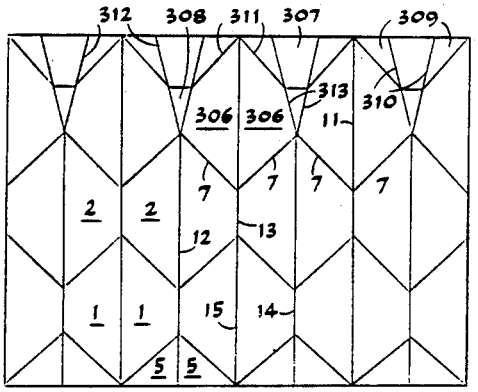
Figure 119:
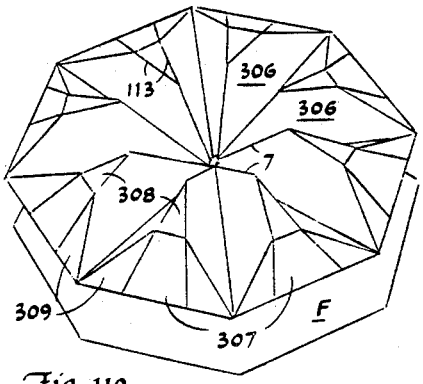
Figure 120:
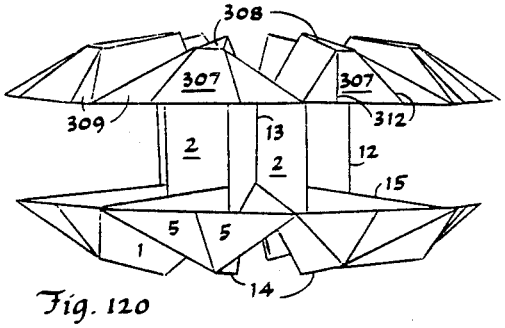

Other polygons, such as trapeziums are illustrated in FIGS. 113–120,123–126. In FIGS. 113–114 the polygons of the upper set (which may form the canopy portion of, e.g. a radial structure) include pairs of trapeziums 296 separated by triangles 298; the sets of middle and lower trapezoids 2 and 1, respectively, have rectangular separating elements 99 and 98 as in FIG. 25. The structure shown in FIG. 113 has 16 trapeziums in its canopy portion and its isosceles triangular elements 298 have their bases at the core portion of the structure. In FIGS. 115–117 there are also 16 trapeziums in the canopy but the arrangement is reversed in that the isosceles triangular elements 303 have their bases at the outer edge of the canopy while the trapeziums 301 are correspondingly narrower at that edge. In FIGS. 118–120 trapeziums 306 are shaped so that their longer sides 11 coincide, there are triangular separating elements 308, and there are edge trapeziums 307 between pairs of edge triangles 309; otherwise the blank (FIG. 118) is identical with the blank shown in FIG. 2.

Figure 121:
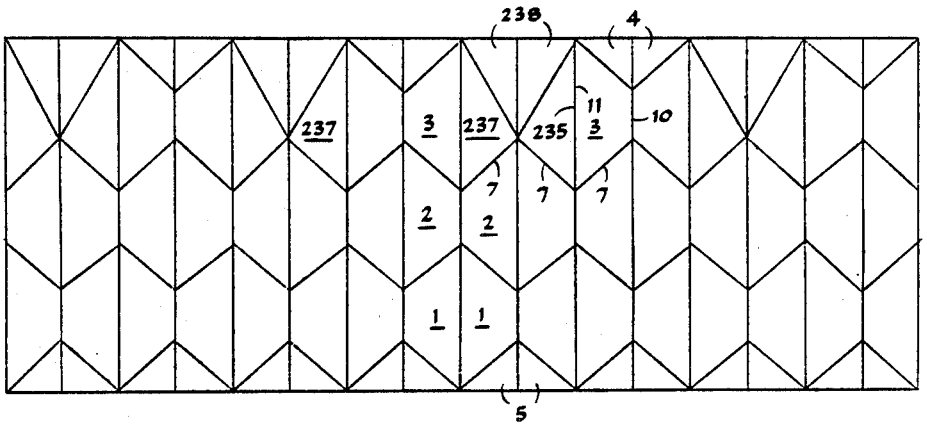
Figure 122:
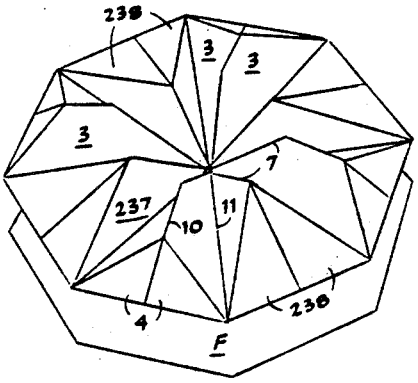
FIG. 122 shows a radial structure made from the blank of FIG. 121

In FIGS. 121–122 the upper set of polygons is made up of pairs triangles 237 (having a common vertex) and pairs of trapezoids 3 having a common side 11,235. The pairs of edge triangles are of two different sizes 4,4 and 238,238.

Figure 123:
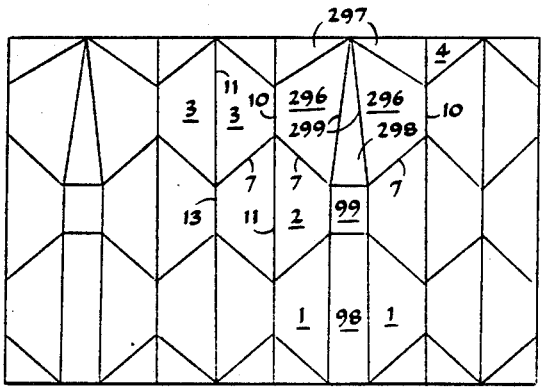
Figure 124:
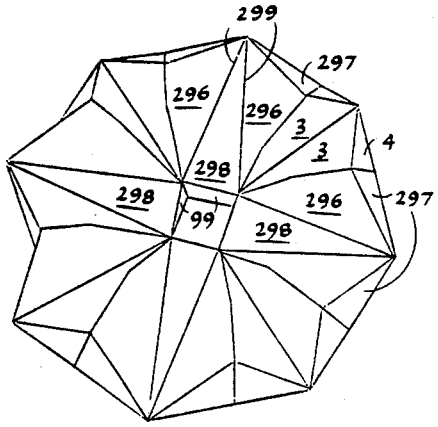
FIG. 124 shows a radial structure made from the blank of FIG. 123.

In FIGS 123–124 the middle and lower sets include trapezoids separated at intervals, by rectangles 99, 98 and the upper set of polygons includes not only pairs of trapezoids 3 but also pairs of trapeziums 296 (having a common vertex) and triangles 298; the structure has two types of upper edge triangles 4 and 297 and the individual upper ridges and edge arrangements) are asymmetrical.

Figure 125:
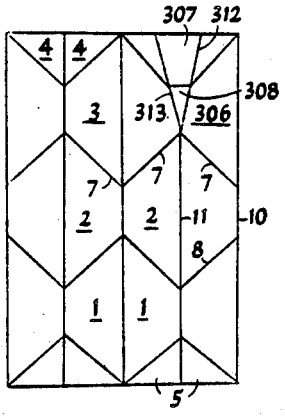
Figure 126:
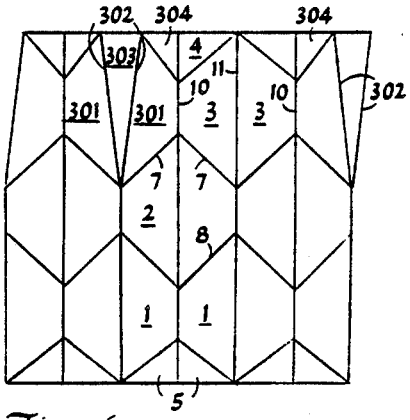

In FIGS. 125 and 126 the upper set includes pairs of trapezoids 3 and pairs of trapeziums. In FIG. 125 there are trapeziums 306 (having a common side 11 with the long base of trapezoid 3) and small triangles 308, while at the edge there are triangles 4, small trapeziums 307 and other edge triangles flanking the latter. In FIG. 126 the pairs of trapeziums 301 of the upper set each have a side 10 in common with the short base of trapezoids 3 and there are outwardly flaring triangles 303 between trapeziums.

It will be appreciated that by alterations such as those indicated herein, the design and volume of the hollow compartments formed (by the use of a ceiling or floor) in the canopy or the base portion may be changed.

In my U.S. Pat. No. 4,001,964 rotatable structures are described. These employ a sufficient number of trapezoids per set to permit a substantial expansion of the outer circumference of the structure when it passes from one stable position to another. The structures of the present invention may have a lesser number of trapezoids (and other polygons) per set and thus be non-rotatable (in the sense used in that patent) and therefore locked in a particular configuration. This applies both to small cardboard (or other) models and to the larger, architectural, structures.

It is particularly desirable that one of the acute angles of the central trapezoids (e.g. angle $\alpha$ of trapezoids 2, 27 or 57) be less than about 48°, such as 45° as illustrated in many of the Figs. This makes for a structure that can collapse to relative flat configuration in which the folded parts (e.g. the projecting elements) do not interfere with each other even though they are of substantial lengths relative to the central trapezoids. It is preferred that the sum of the angles $\alpha$ and $\beta$ of the central trapezoids be at most 100°.

It is understood that the foregoing detailed description is given merely by way of illustration and that variations may be made therein without departing from the spirit of the invention.

I claim:

1. An architectural structure which is a shelter in which trapezoidal elements of a first set are interconnected in pleated relationship with trapezoid and pleat edges thereof coinciding, trapezoidal elements of a second set are interconnected in pleated relationship with trapezoid and pleat edges thereof coinciding and interfit in connected relationship with and extend transversely to said elements of said first set, each of said first-set-elements has a short base and a long base, an angled side which makes an acute angle with said long base at a vertex and an obtuse angle with said short base at another vertex, and said bases of all said first-set-elements are parallel and substantially vertical, said second-set-elements have first sides in common with said angled sides and have vertices, at the ends of said common sides, in common with said actute- and obtuse-angle vertices, said second-set-elements have bases which extend from said obtuse-angle vertices in a direction transverse to the first-set-element short bases, said first set, of elements, is arranged in an arc, said second set, of elements, extends radially from said arc to form a substantially horizontal canopy, cantilevered from said first set, in which said second-set-elements are in a warped, stressed non-planar smooth-curved condition, said structure having a substantially flat floor adjacent the lower portions of said first-set elements, said floor being secured to said structure so as to provide stability to said structure, polygonal elements of a third set are interconnected in pleated relationship with polygon and pleat edges thereof coinciding and interfit in connected relationship with said first set, of elements, and extend transversely to said elements of said first set, said third set-elements have first sides in common with second angled sides of said first-set-elements and have vertices, at the ends thereof, in common with acute- and obtuse-angle vertices of said first-set-elements, said third-set-elements have second sides which extend from said latter obtuse-angle vertices in a direction transverse to the first-set-element short bases and said third-set-elements underlie said floor.

2. A structure as in claim 1 in which said third-set-elements comprise trapezoids whose bases extend substantially horizontally and radially from said arc.

3. A structure as in claim 2 in which said floor rests on ridges formed by the long bases of said third-set-trapezoids.

4. An architectural structure as in claim 2 in which said trapezoids and polygons are of metal sheet material.

5. An architectural structure as in claim 2 in which said trapezoids and polygons are of plastic sheet material.

6. A structure as in claim 2 in which said polygonal elements have 3 to 4 sides.

7. A structure as in claim 6 in which trapezoids of said first set have short bases in common with short bases of adjacent trapezoids of said first set.

8. A structure as in claim 6 in which trapezoids of said first set have long bases in common with long bases of adjacent trapezoids of said first set.

9. A structure as in claim 6 in which trapezoids of said first set have short and long bases in common with short and long bases of adjacent trapezoids of said first set.

10. A structure as in claim 6 in which trapezoids of said first set are separated from adjacent trapezoids of said first set by intervening rectangles and trapezoids of said second set are separated from adjacent trapezoids of said second set by intervening polygons.

* * * * *